US009079425B2

(12) United States Patent
Adachi

(10) Patent No.: US 9,079,425 B2
(45) Date of Patent: Jul. 14, 2015

(54) PRINT CONTROL METHOD, PRINTING METHOD, AND CONTINUOUS SHEET TO BE PRINTED USED IN THE METHOD

(71) Applicant: CANON KABUSHIKI KAISHA, Tokyo (JP)

(72) Inventor: Minako Adachi, Yamato (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/955,032

(22) Filed: Jul. 31, 2013

(65) Prior Publication Data

US 2014/0035986 A1 Feb. 6, 2014

(30) Foreign Application Priority Data

Jul. 31, 2012 (JP) ..... 2012-169675

(51) Int. Cl.

| | |
|---|---|
| ***B41J 29/38*** | (2006.01) |
| ***B41J 3/407*** | (2006.01) |
| ***B41J 15/00*** | (2006.01) |
| ***B41J 3/60*** | (2006.01) |
| ***B41J 11/00*** | (2006.01) |

(52) U.S. Cl.

CPC .. *B41J 15/00* (2013.01); *B41J 3/60* (2013.01); *B41J 11/008* (2013.01)

(58) Field of Classification Search

CPC ..... B41J 3/60

See application file for complete search history.

(56) References Cited

U.S. PATENT DOCUMENTS

| | | | | |
|---|---|---|---|---|
| 4,268,943 | A | 5/1981 | Watanabe et al. | |
| 4,317,270 | A | 3/1982 | Watanabe et al. | |
| 5,532,789 | A | 7/1996 | Yaginuma et al. | |
| 5,745,217 | A * | 4/1998 | Factor | 355/40 |
| 5,915,146 | A | 6/1999 | Kusaka et al. | |
| 6,179,287 | B1 | 1/2001 | Watanabe et al. | |
| 6,240,263 | B1 | 5/2001 | Watanabe et al. | |
| 6,575,546 | B2 | 6/2003 | Matsumoto et al. | |
| 7,050,751 | B2 | 5/2006 | Watanabe et al. | |
| 2004/0100622 | A1 * | 5/2004 | Kaltenbach et al. | 355/40 |
| 2011/0279508 | A1 | 11/2011 | Naito | |
| 2011/0310151 | A1 * | 12/2011 | Serizawa | 347/14 |
| 2013/0088541 | A1 | 4/2013 | Naito | |
| 2013/0215448 | A1 * | 8/2013 | Gentile et al. | 358/1.13 |

FOREIGN PATENT DOCUMENTS

| | | |
|---|---|---|
| JP | H03-197140 | 8/1991 |
| JP | 2002-046260 | 2/2002 |
| JP | 2003-237157 | 8/2003 |
| JP | 4278885 | 6/2009 |
| JP | 2011-240492 | 12/2011 |
| JP | 2011-240493 | 12/2011 |

* cited by examiner

*Primary Examiner* — Shelby Fidler

(74) *Attorney, Agent, or Firm* — Fitzpatrick, Cella, Harper & Scinto

(57) ABSTRACT

In duplex printing on a continuous sheet, a schedule for the printing is appropriately set depending on a unique portion present on the sheet. On the continuous sheet, a plurality of images is printed according to the schedule. First, information, that is preliminarily recorded on the continuous sheet to be used, with respect to a location of the unique portion present on the continuous sheet and a sheet surface where the unique portion is present are obtained. Then, on the basis of the obtained information, the schedule is set so as to print the images with avoiding the unique portion.

23 Claims, 15 Drawing Sheets

| LEVEL | EXAMPLE |
|---|---|
| LIGHT LEVEL | LIGHT FLAW AND/OR DIRT NOT INFLUENCING SURFACE<br>*LEVEL ENOUGH TO BE ABLE TO RECOGNIZE PRINTED IMAGE ON UNIQUE PORTION |
| INTERMEDIATE LEVEL | LIGHT FLAW AND/OR DIRT NOT INFLUENCING SURFACE<br>*LEVEL NOT ENOUGH TO RECOGNIZE PRINTED IMAGE ON UNIQUE PORTION |
| HEAVY LEVEL | TEAR, HOLE, AND/OR SPLICE TAPE<br>HEAVY FLAW AND/OR DIRT INFLUENCING SURFACE |

FIG.3

PRINT CONTROL METHOD, PRINTING METHOD, AND CONTINUOUS SHEET TO BE PRINTED USED IN THE METHOD

BACKGROUND OF THE INVENTION

1. Field of the Invention

The present invention relates to a printing method that performs duplex printing on a continuous sheet.

2. Description of the Related Art

In order to continuously do a lot of printing such as lab printing, a printing apparatus of a type that performs printing on a roll shape continuous sheet is used in some cases. As the roll shape continuous sheet, there is one having areas such as unclean areas and sheet joining parts where printing cannot be performed. Japanese Patent Laid-Open No. 2003-237157 discloses a printing apparatus that preliminarily marks such areas on a roll sheet; when detecting such marked parts by a sensor, cuts the marked parts; and collects the cut marked parts. In doing so, the areas not enough to perform printing are not printed, but cut and collected, and in areas suitable for printing, a print operation is performed.

However, even in the case were areas where printing cannot be performed are present due to the attachment of dust, dirt, and the like on one of surfaces, depending on a level of such uncleanliness, the other surface in the areas can be printed in some cases. Even in such cases, the printing apparatus disclosed in Japanese Patent Laid-Open No. 2003-237157 cuts and collects such areas, so that such parts can no longer be used, and therefore a sheet may not be able to be efficiently used.

SUMMARY OF THE INVENTION

Therefore, the present invention is, in consideration of the above-described situations, intended to provide a method that, in the case where at the time of printing both sides of a continuous sheet, a unique portion is present on the sheet, appropriately sets a print schedule to be thereby able to use the sheet more efficiently.

According to the present invention, a print control method for printing a plurality of images on a continuous sheet according to a schedule, the method comprising: obtaining information about the continuous sheet to be used, the information representing a location of a unique portion unsuitable for image printing that exists on the continuous sheet, and a sheet surface in which the unique portion exists; and setting the schedule, on a basis of obtained information, so as not to perform printing of an image on the unique portion.

According to the present invention, a printing method for printing a plurality of images on a continuous sheet according to a schedule, the method comprising: obtaining information about the continuous sheet to be used, the information representing a location of a unique portion unsuitable for image printing that exists on the continuous sheet, and a level of the unique portion; and setting the schedule on a basis of obtained information, so as not to perform printing of an image on the unique portion.

According to the present invention, at the time of printing both sides of a continuous sheet, depending on the type of a unique portion present on the sheet, a print schedule is set. For this reason, the sheet can be efficiently used.

Further features of the present invention will become apparent from the following description of exemplary embodiments (with reference to the attached drawings).

BRIEF DESCRIPTION OF THE DRAWINGS

FIG. 3 is a table listing levels of unique portions present on a sheet on a level basis;

DESCRIPTION OF THE EMBODIMENTS

In the following, an embodiment of a printing apparatus using an inkjet method is described. A printing apparatus in the present embodiment is a high-speed line printing apparatus that uses a long-sized continuous print sheet (continuous sheet longer than a length of a repetitive print unit (referred to as one page or a unit image) in a conveyance direction), and is compatible with both of simplex printing and duplex printing. For example, the printing apparatus is suitable for a field of a large number of sheets of printing in a print lab or the like. Note that, in the present specification, even in the case where within an area of one print unit (one page), pluralities of small images, characters, and blanks are mixed, the objects included in the area are collectively referred to as one unit image. That is, the unit image means one print unit (one page) in the case of sequentially printing a plurality of pages on a continuous sheet. In addition, there is also the case of not referring to the unit image but simply referring to an image. A length of the unit image is different depending on a size of an image to be printed. For example, in the case of an L size photograph, a length in the sheet conveyance direction is 135 mm, whereas in the case of an A4 size, the length in the sheet conveyance direction is 297 mm. The present invention is widely applicable to printing apparatuses that use ink and requires drying, such as printers, multifunction printers, copying machines, facsimile machines, and manufacturing apparatuses for various types of devices.

Figure 1:
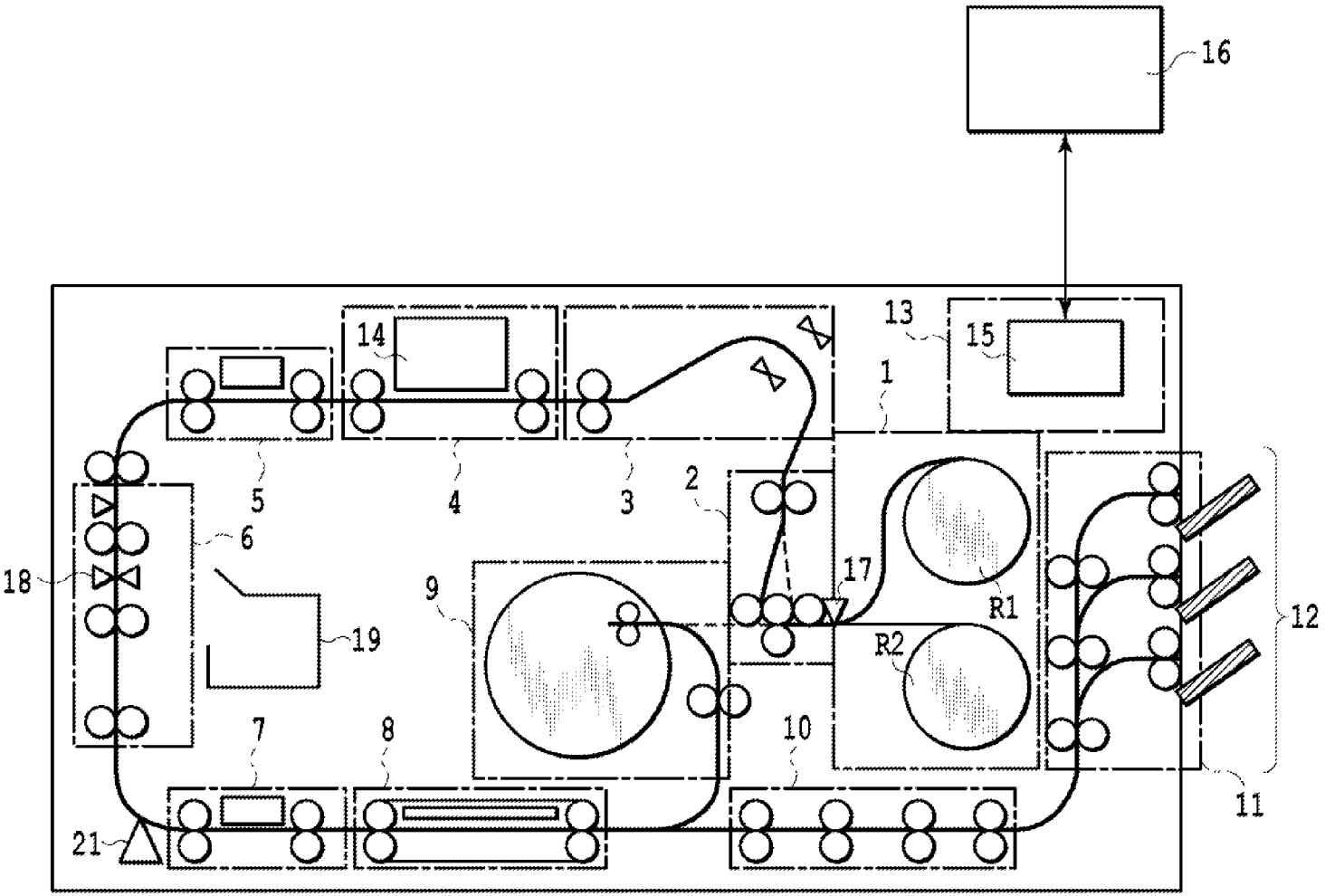
FIG. 1 is a schematic cross-sectional view illustrating an overall configuration of a printing apparatus according to an embodiment of the present invention.

FIG. 1 is a schematic cross-sectional view illustrating an internal configuration of the printing apparatus. The printing apparatus of the present embodiment is adapted to be able to use a sheet, which is wound in a roll shape, to perform duplex printing on a first surface of the sheet and on a second surface that is on aback side of the first surface. Inside the printing apparatus, roughly, respective units of a sheet supplying unit 1, decurling unit 2, skewing correcting unit 3, printing unit 4, inspecting unit 5, cutter unit 6, information recording unit 7, drying unit 8, reversing unit 9, discharging/conveying unit 10, sorter unit 11, discharge unit 12, and control unit 13 are provided. The discharge unit 12 refers to a unit that contains the sorter unit 11 and performs a discharge process. The sheet is conveyed by a conveyance mechanism including pairs of rollers and belts along sheet conveyance paths indicated by solid lines in FIG. 1, and processed in the respective units. Note that at an arbitrary location in the sheet conveyance paths, a side closer to the sheet supplying unit 1 is referred to as an "upstream" side, and a side opposite to the upstream side is referred to as a "downstream" side.

The sheet supplying unit 1 is a unit for retaining and supplying the continuous sheet wound in a roll shape. The sheet supplying unit 1 can contain two rolls R1 and R2, and is configured to alternatively draw any of the sheets to supply it. Note that the number of containable rolls is not limited to two, and the sheet supplying part 1 may be one that contains one roll, or three or more rolls. Also, as long as a sheet is continuous, the sheet is not limited to one wound in a roll shape. For example, the present invention may be adapted such that a continuous sheet provided with unit length-based perforations is folded back at each of the perforations, and the folded pieces are stacked and then contained in the sheet supplying unit 1.

The continuous sheet used in the present embodiment is assumed to have spliced parts (joining parts) joined with a tape or a glue in one or more and random locations. The spliced parts are areas not suitable for image printing. As described, in the present embodiment, in some cases, a sheet is used, on which unique portions such as the spliced parts as joining parts between sheet pieces are present, which are areas that have different characteristics from the other parts within the sheet and are therefore unsuitable for image printing. Even in the case of performing printing on the sheet on which such unique portions are present, the unique portions have different characteristics as compared with the other parts of the sheet, and therefore only printed images on the unique portions are seen with being varied. In the case of performing printing in the unique portions, image appearances are different only in the unique portions, and therefore quality of an overall printed image may be reduced. Therefore, in the present embodiment, in the case where such unique portions are present on a sheet, identification marks for indicating the presence of the unique portions are printed at locations corresponding to the unique portions on the sheet.

Near an outlet of the sheet supplying unit 1, an identification mark sensor (reading device) 17 adapted to be able to sense the identification marks printed on the sheet is provided. The identification mark sensor 17 detects the identification marks printed in the locations corresponding to the unique portions on the continuous sheet supplied from the sheet supplying unit 1. Details of the identification mark sensor 17 will be described later.

The decurling unit 2 is a unit that reduces a degree of a curl (curve) of the sheet supplied from the sheet supplying unit 1. The decurling unit 2 makes decurling force act to reduce a degree of a curl by using two pinch rollers for one driving roller and passing the sheet with curving the sheet so as to provide a curve in a direction opposite to a direction of the curl.

The skewing correcting unit 3 is a unit that corrects skewing (an inclination of the sheet with respect to an original traveling direction of the sheet) of the sheet having passed through the decurling unit 2. By pressing a sheet end part on a side serving as a reference against a guide member, the skewing of the sheet is corrected. In the skewing correcting unit 3, the sheet being conveyed is formed with a loop.

The printing unit (printing means) 4 is a sheet processing unit that performs a print process on the currently conveyed sheet by a print head 14 from above, and thereby forms an image. That is, the printing unit 4 is a processing unit that performs a predetermined process on the sheet. The printing unit 4 prints images on the front surface (first surface) and back surface (second surface) of the sheet according to a predetermined schedule. The printing unit 4 is also provided with a plurality of conveying rollers that convey the sheet. The print head 14 has line type print heads each of which is formed with an inkjet type nozzle array over a range covering a maximum width of the sheet, which is assumed to be used. In the print head 14, the plurality of print heads is parallel arranged along the conveyance direction. In the present embodiment, the print head 14 has seven print heads corresponding to seven colors of C (cyan), M (magenta), Y (yellow), LC (light cyan), LM (light magenta), G (gray) and K (black). Note that the number of colors and the number of print heads are not limited to seven. As the inkjet method, a method using heating elements, a method using piezoelectric elements, a method using electrostatic elements, a method using MEMS elements, or another method can be employed. Inks for the colors are respectively supplied from ink tanks to the print head 14 through ink tubes.

The inspecting unit 5 is a unit for optically reading an inspection pattern or image, which was printed on the sheet in the printing unit 4, by a scanner, and inspecting states of the nozzles of the print heads, a sheet conveyance state, an image location, and the like to determine whether or not the image was correctly printed. The scanner has a CCD image sensor or a CMOS image sensor.

The cutter unit 6 is a unit provided with a mechanical cutter 18 that cuts the printed sheet into a predetermined length. Further, the cutter unit 6 is also provided with: a cut mark sensor that optically detects a cut mark recorded on the sheet; and a plurality of conveying rollers for sending out the sheet to the next process. Near the cutter unit 6, a trash box 19 is provided. The trash box 19 is one that contains small sheet pieces that are cut in the cutter unit 6 and discharged as trash. The cutter unit 6 is provided with a sorting mechanism that discharges the cut sheet pieces into the trash box 19 or transfers the sheet to the original conveyance path.

The information recording unit 7 is a unit that, in a non-print area of the cut sheet, records print information (specific information) including a serial number, a date, and the like of the print. The recording is performed by printing characters or a code in an inkjet manner or a thermal transfer manner. On the upstream side of the information recording unit 7 and on the downstream side of the cutter unit 6, a sensor 21 that senses a front edge of the cut sheet is provided. On the basis of sensing timing of the sensor 21, timing at which information recording is performed in the information recording unit 7 is controlled.

The drying unit 8 is a unit for heating the sheet printed in the printing unit 4, and thereby drying applied inks in a short period of time. Inside the drying unit 8, hot air is provided to the passing sheet from at least a lower surface side to dry an ink application surface. Note that a drying method is not limited to the method that provides hot air, but may be a method that irradiates a sheet surface with an electromagnetic wave (such as ultraviolet or infrared).

The sheet conveyance path from the sheet supplying unit 1 to the drying unit 8 described above is referred to as a first path. The first path has a U-turn shape between the printing unit 4 to the drying unit 8, and the cutter unit 6 is located in the middle of the U-turn shape.

The reversing unit 9 is a unit for, in the case of performing the duplex printing, temporarily rewinding the continuous sheet having been subjected to front surface printing, and thereby reversing the sheet in terms of a surface of the sheet. The reversing unit 9 is provided in the middle of a path (loop path) (referred to as a second path) that is intended to supply the sheet having passed through the drying unit 8 to the printing unit 4 again and arranged from the drying unit 8 to the printing unit 4 through the decurling unit 2. The reversing unit 9 is provided with a rewinding rotary body (drum) that is rotatable and intended to rewind the sheet. The continuous sheet that has been subjected to the front surface printing but is not cut is temporarily rewound by the rewinding rotary body. After the end of the rewinding, the rewinding rotary body reversely rotates to send the wound sheet in order opposite to that at the time of the rewinding, and the sheet is supplied to the decurling unit 2 and then sent to the printing unit 4. The sheet is reversed in terms of a surface of the sheet, and therefore in the print unit 4, printing can be performed on the back surface. Given that the sheet supplying unit 1 is referred to as a first sheet supplying unit, the reversing unit 9 can be considered as a second sheet supplying unit. More specific operation of the duplex printing will be described later.

The discharging/conveying unit 10 is a unit for conveying the sheet having been cut in the cutter unit 6 and dried in the drying unit 8, and passing the sheet down to the sorter unit 11. The discharging/conveying unit 10 is provided in a path (referred to as a third path) different from the second path provided with the reversing part 9. In order to selectively guide the sheet having been conveyed through the first path to any one of the second and third paths, at a path branching location (referred to as a "discharge branching location"), a path switching mechanism having a movable flapper is provided.

The discharge unit 12 containing the sorter unit 11 is provided in a lateral part to the sheet supplying unit 1 and at a terminal of the third path. The sorter unit 11 is a unit for sorting printed sheets on a group basis as needed. The sorted sheets are discharged to a plurality of trays the discharge unit 12 has. As described, the third path is laid out to pass below the sheet supplying unit 1, and discharge the sheet toward a side opposite to the printing unit 4 and the drying unit 8 across the sheet supplying unit 1.

As described above, units from the sheet supplying unit 1 to the drying units 8 are sequentially provided in the first path. On a forward side of the drying part 8, the first path is branched into the second path and the third path. Also, in the middle of the second path, the reversing unit 9 is provided, and on a forward side of the reversing unit 9, the second path joins the first path. At the terminal of the third path, the discharge unit 12 is provided.

The control unit 13 is a unit that manages control of the respective units in the whole of the printing apparatus. The control unit 13 has a CPU, storage device, controller provided with various types of control parts, external interface, and operation part 15 through which a user performs input/output. Operation of the printing apparatus is controlled on the basis of an instruction from the controller or a host device 16 such as a host computer connected to the controller through the external interface.

Figure 2:
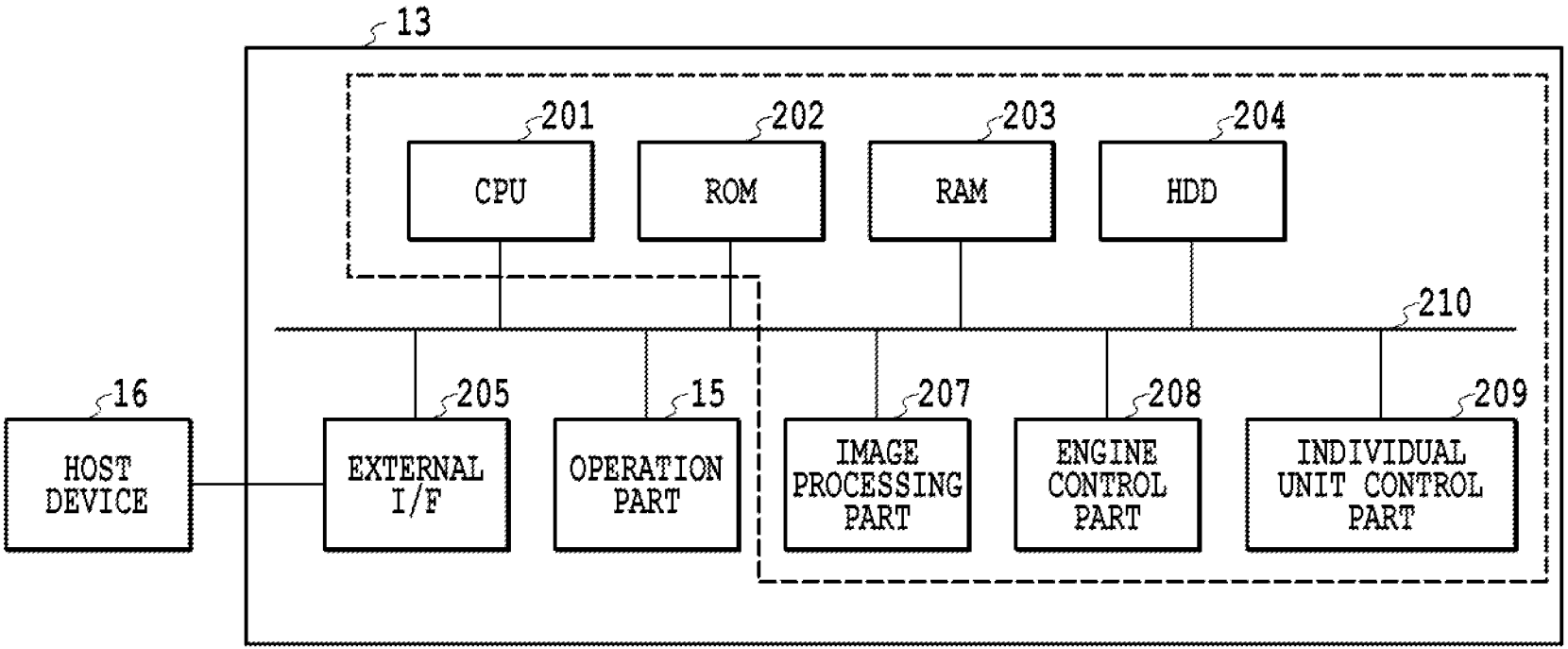
FIG. 2 is a block diagram illustrating a schematic configuration of a control system.

FIG. 2 is a block diagram illustrating a concept of the control unit 13. The controller (range surrounded by a dashed line) included in the control unit 13 is configured to include a CPU 201, ROM 202, RAM 203, HDD 204, image processing part 207, engine control part 208, and individual unit control part 209. The CPU 201 (central processing unit) integrally controls operations of the respective units of the printing apparatus. The ROM 202 stores a program executed by the CPU 201 and pieces of fixed data necessary for various operations of the printing apparatus. The RAM 203 is used as a work area for the CPU 201, used as a temporary storage area for various pieces of received data, or stores various types of setting data. The HDD 204 (hard disk) can store and read a program for the CPU 201 to execute, print data, and pieces of setting information necessary for various operations of the printing apparatus. The operation part 15 is an input/output interface with the user, and includes: an input part including hard keys and a touch panel; and an output part including a display for presenting information and a sound generator.

For a unit requiring high-speed data processing, a dedicated processing part is provided. The image processing part 207 performs image processing of print data handled in the printing apparatus. Color space (e.g., YCbCr) of inputted image data is converted to standard RGB color space (e.g., sRGB). Also, various types of image processing such as resolution conversion, image analysis, and image correction are performed on image data as needed. Print data obtained by these types of image processing is stored in the RAM 203 or the HDD 204. The engine control part 208 performs driving control of the print head 14 of the printing unit 4 according to print data on the basis of a control command received from the CPU 201 or the like. The engine control part 208 further controls conveyance mechanisms of the respective units in the printing apparatus. The individual unit control part 209 is a sub-controller for individually controlling the respective units of the sheet supplying unit 1, decurling unit 2, skewing correcting unit 3, inspecting unit 5, cutter unit 6, information recording unit 7, drying unit 8, reversing unit 9, discharging/conveying unit 10, sorter unit 11, and discharge unit 12. On the basis of an instruction by the CPU 201, operation of each of the units is controlled by the individual unit control part 209. The external interface 205 is an interface (I/F) for connecting the controller to the host device 16, and a local I/F or a network I/F. The above components are connected to one another through a system bus 210.

The host device 16 is a device serving as a supply source of image data for making the printing apparatus perform printing. The host device 16 may be a general-purpose or dedicated computer, or an image device having an image reader part, such as an image capturing device, digital camera, or photo storage device. In the case where the host device 16 is a computer, an OS, application software for generating image data, and a printer driver for the printing apparatus are installed in a storage device included in the computer. Note that the present invention does not indispensably realize all of the above-described pieces of processing by software, but may be adapted to realize part or all of them by hardware.

Next, basic operation of the printing apparatus at the time of printing is described. Printing is different in operation between a simplex print mode and a duplex print mode, and therefore printing in each of the modes is described.

In the simplex print mode, a sheet that has been supplied from the sheet supplying unit 1 and processed respectively in the decurling unit 2 and skewing correcting unit 3 is subjected to printing on a front surface (first surface) in the printing unit 4. Images (unit images) each having a predetermined unit length in the conveyance direction are sequentially printed on the long-sized continuous sheet to form the plurality of images with lining the images. The printed sheet moves through the inspecting unit 5, and is cut for each of the unit images in the cutter unit 6. Regarding each of cut sheets, as needed, information on the image printed on the first surface is recorded on the second surface of the sheet in the information recording unit 7. Then, the cut sheets are conveyed to the drying unit 8 and dried one by one. After that, the cut sheets move through the discharging/conveying unit 10, and are sequentially discharged to the discharge unit 12 of the sorter unit 11 and stacked. On the other hand, the sheet left on the printing unit 4 side after the cutting of the last unit image is sent back to the sheet supplying unit 1, and rewound by the roll R1 or R2. As described, in the simplex printing, the sheet is processed with passing through the first and third paths, but does not pass through the second path.

On the other hand, in the duplex print mode, following a front surface (first surface) print sequence, a back surface (second surface) print sequence is performed. In the first front surface print sequence, operation in each of units from the sheet supplying unit 1 to the inspecting unit 5 is the same as that in the case of the above-described simplex printing. In the cutter unit 6, a cutting operation is not performed, and a continuous sheet is conveyed to the drying unit 8 as it is. After drying ink on the front surface in the drying unit 8, the sheet is guided not to the path (third path) on the discharging/conveying unit 10 side but to the path (second path) on the reversing unit 9 side. In the second path, the sheet is rewound by the rewinding rotary body of the reversing unit 9, which rotates in a forward direction (in the view, an anticlockwise direction). After scheduled front surface printing has been entirely finished in the printing unit 4, a rear end of a print area of the continuous sheet is cut in the cutter unit 6. With reference to a cutting location, the continuous sheet on the downstream side (printed side) in the conveyance direction moves through the drying unit 8, and is, in the reversing unit 9, entirely rewound down to the sheet rear end (cutting location). On the other hand, simultaneously with the rewinding in the reversing unit 9, the continuous sheet left on the upstream side (printing unit 4 side) of the cutting location in the conveyance direction is sent back to the sheet supplying unit 1 so as to prevent a sheet fore end (cutting location) from remaining in the decurling unit 2, and then rewound by the roll R1 or R2. The sending back (back-feed) causes a collision with the sheet, which is to be supplied again in the following back surface print sequence, to be avoided.

After the above-described front surface print sequence, the sequence is switched to the back surface print sequence. The rewinding rotary body of the reversing unit 9 rotates in a direction opposite to that at the time of the rewinding (in the view, rotates in a clockwise direction). The end part of the rewound sheet (the sheet rear end at the time of the rewinding serves as a sheet front end at the time of sending) is sent to the decurling unit 2 along a path indicated by a dashed line in FIG. 1. In the decurling unit 2, a curl provided by the rewinding rotary body is corrected. That is, the decurling unit 2 is provided between the sheet supplying unit 1 and the printing unit 4 in the first path, and also between the reversing unit 9 and the printing unit 4 in the second path, and in both of the paths, serves as a shared unit doing decurling work. The sheet reversed in terms of a surface of the sheet is sent to the printing unit 4 through the skewing correcting unit 3, and printing is performed on the back surface of the sheet. The printed sheet moves through the inspecting unit 5, and is, in the cutter unit 6, cut by the predetermined unit length that is preset. The cut sheets are printed on both surfaces thereof, and therefore recording in the information recording unit 7 is not performed. The cut sheets are conveyed to the drying unit 8 one by one, and through the discharging/conveying unit 10, sequentially discharged to the discharge unit 12 of the sorter unit 11 and stacked. As described, in the duplex printing, the sheet is processed with passing in order of the first path, second path, first path, and third path.

In the printing apparatus of the present embodiment, the identification mark sensor 17, which is an optical sensor, is provided between the sheet supplying unit 1 and the decurling unit 2. The identification mark sensor 17 detects an identification mark that is preliminarily recorded on a back surface of a sheet. This causes pieces of information included in the identification mark to be obtained. The identification mark is one in which pieces of information on a sheet surface, location, and class (defect level) corresponding to a unique portion present on a sheet are coded. In the present embodiment, identification marks are preliminarily recorded collectively on a second surface of a sheet and near a plurality of unique portions presents on the continuous sheet. In the case where a unique portion is present on a first surface, an identification mark is recorded on a corresponding sheet back surface.

Note that pieces of information (sheet surface, location, and class) on a unique portion present on a sheet are not limited to ones recorded in the middle of the sheet as a mark, but may be ones that are collectively recorded in a leading end part (top part) of the sheet in the form like a barcode. Alternatively, the present invention may be configured such that pieces of information are collectively recorded not on a continuous sheet itself but on a package packing the sheet as a code, and a user inputs the pieces of information on the package to the host device with use of a reading device such as a code reader. Further, the present invention may be configured such that a memory medium in which pieces of information are collectively recorded is attached to a package for a sheet, and a user inputs the pieces of information in the memory medium to the host device with use of a reading device such as a card reader. By reading the pieces of information inputted to the host device, the pieces of information can be obtained.

Examples of a unique portion present on a sheet include a flaw, fold, tear, dust, dirt, foreign substance, discoloration, impurity, uneven part in thickness, splice tape joining roll sheets, and the like, which are partially provided on the sheet at the time of roll sheet manufacturing and unacceptable for image printing. An identification mark has: sheet surface information that indicates which of front and back surfaces of a sheet a unique portion is present on; and XY location (coordinates on the sheet) information that, given that the conveyance direction of the sheet is an X direction, and a direction vertical to the X direction is a Y direction, indicates where the unique portion is present in the X direction and the Y direction. Further, the identification mark has information on an after-mentioned class (level) of the unique portion.

FIG. 3 is a diagram illustrating classifications (classes) based on a level of a unique portion. FIG. 3 shows characteristics of a unique portion in each of the classes. Light and intermediate levels are both classes that are enough to make an influence on one surface of a sheet but not to make an influence on the back surface side, and have a small flaw, dirt, and/or the like. Of these levels, the light level is one at which, in the case of printing on a unique portion, printed content can be recognized. The intermediate level is one at which printed content cannot be recognized. On the other hand, a heavy level is a class that is enough to make an influence not only on one surface of a sheet but on both surfaces, and has a deep flaw, tear, hole, splice tape joining roll sheets, and/or the like.

Note that, in the present embodiment, a level of a unique portion is set to any of the three classes of the light level, intermediate level, and heavy level; however, the present invention is not limited to the three-staged classes, but may set two-staged classes or four-staged or more classes, and set a schedule depending on each of the classes. An identification mark is assumed to be recorded without making an influence on a sheet surface. In the present embodiment, described is the case where regardless of which of front and back surfaces a unique portion is present on, an identification mark is present on the back surface; however, the present invention is not limited to this.

Figure 4:
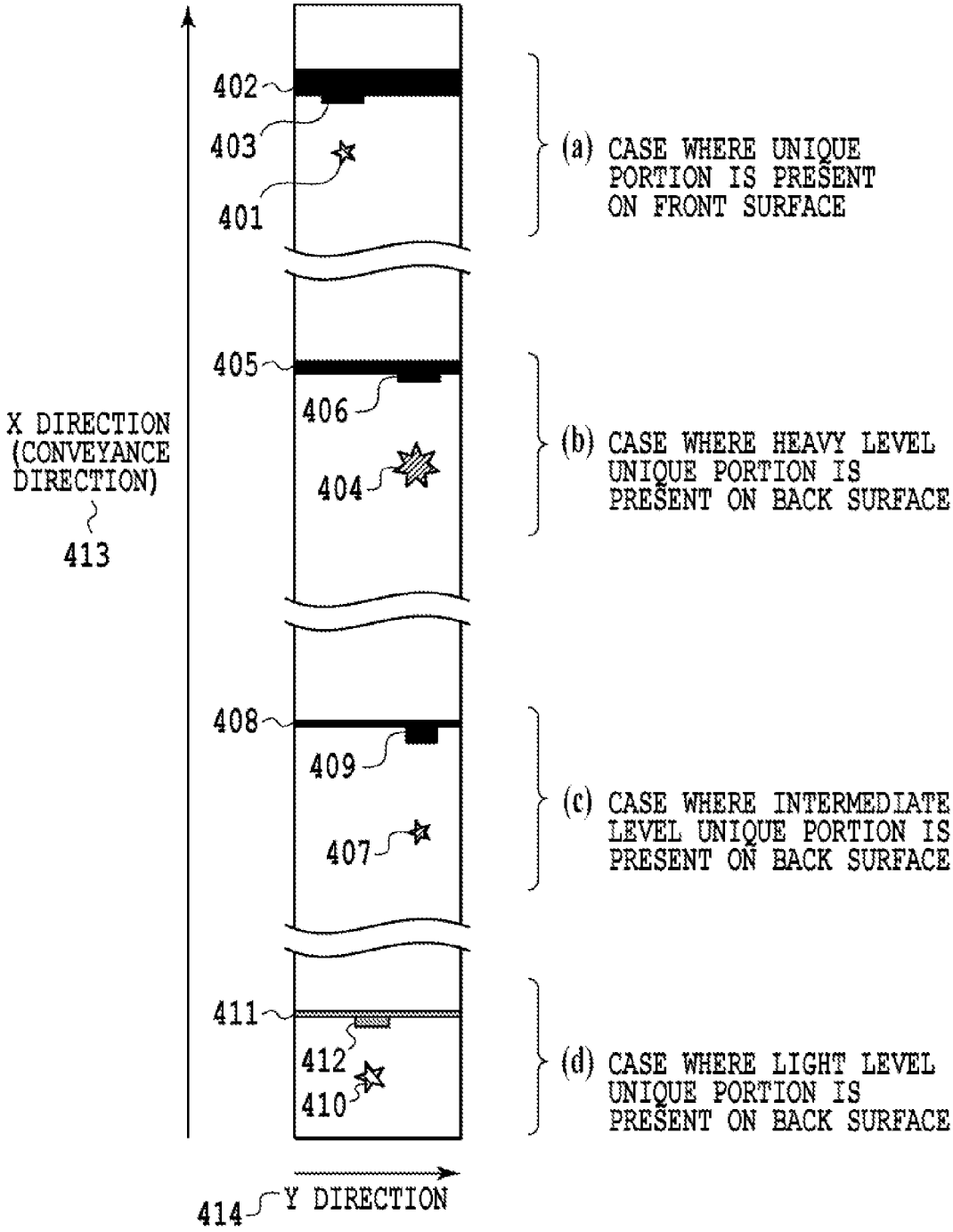
FIG. 4 is a plan view illustrating unique portions in the case where the unique portions are present on a sheet, and identification marks printed corresponding to the unique portions.

FIG. 4 is a plan view illustrating a back surface of a sheet on which identification marks are printed. As illustrated in FIG. 4, on the sheet, unique portions 401, 404, 407, and 410 are present. Also, on the sheet, identification marks 402, 403, 405, 406, 408, 409, 411, and 412 are printed. The conveyance direction of the sheet is an X direction 413 illustrated in FIG. 4. Also, a width direction of the sheet, which is orthogonal to the X direction as the conveyance direction of the sheet, is defined as a Y direction 414. The identification marks are represented by combinations of solid lines 402, 405, 408, and 411 formed as straight lines parallel to the Y direction and protruding parts 403, 406, 409, and 412 protruding from the solid lines 402, 405, 408, and 411 in the X direction, respectively.

As indicated by each of the identification marks in FIG. 4, the identification mark of the present embodiment represents surface information and level information on a unique portion on the basis of a thickness of a solid line. In the present embodiment, (a) in the case where a unique portion is present on a front surface, a solid line part of the identification mark is printed with a black thick line. Also, (b) in the case where a unique portion having the heavy level is present on the back surface, a solid line part of the identification mark is printed with a black medium line. Further, (c) in the case where a unique portion having the intermediate level is present on the back surface, a solid line part of the identification mark is printed with a black thin line. Still further, (d) in the case where a unique portion having the light level is present on the back surface, a solid line part of the identification mark is printed with a gray thin line.

Also, an identification mark of the present embodiment represents information on locations of a unique portion in the X and Y directions on the basis of a location of a protruding part. Details of information on locations in the X and Y directions will be described later with use of FIG. 5.

In the present embodiment, described is an example where an identification mark is located on a forward side (downstream side) and a corresponding unique portion is located on a backward side (upstream side) such that, in terms of conveyance order, the identification mark first passes a predetermined location in a conveyance path, and then the unique portion passes the predetermined location. However, the present invention is not limited to this, but may reversely arrange a locational relationship between an identification mark and a corresponding unique portion. Also, in the present embodiment, a level indicated by an identification mark is represented by a thickness of a solid line part. Note that, in the present embodiment, cited is an example of an identification mark indicating surface information and level information; however, the present invention is not limited to this. The present invention may set as an identification mark, a mark representing a level of a unique portion as a wavy line or multiple lines, or set as an identification mark, a mark blacking out a unique portion itself. Also, an identification mark may be configured not to have information on a distance to a unique portion.

Figure 5:
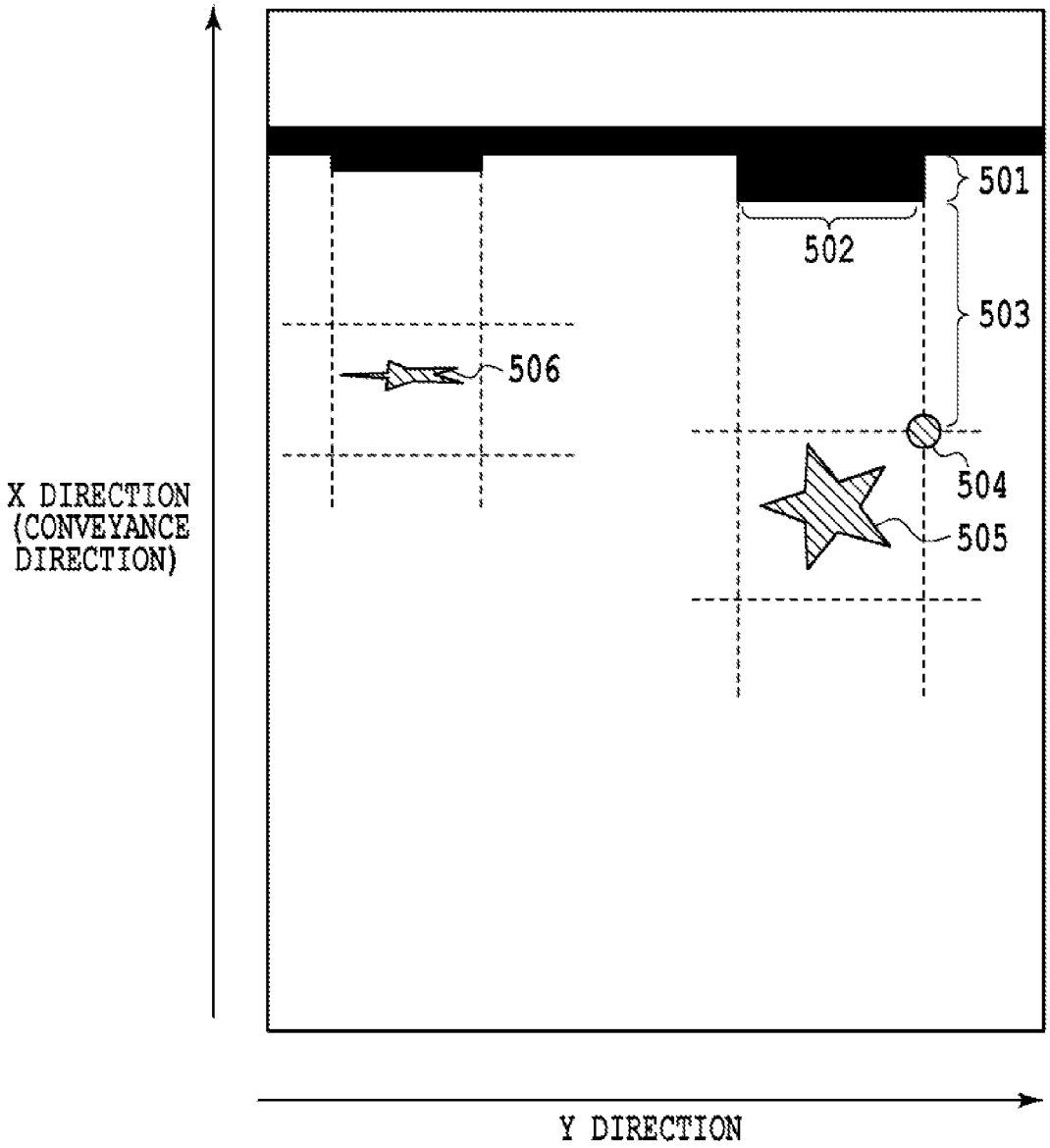
FIG. 5 is a plan view of a sheet on which information on a unique portion included in an identification mark is shown in the case where the unique portion is present on the sheet.

FIG. 5 is an explanatory diagram for explaining locational information on a unique portion in the X and Y directions, which an identification mark printed on a sheet has. By multiplying a protruding length 501 of a protruding part from a solid line by a predetermined specified value, an X directional distance 503 from the protruding part of the identification mark to the unique portion is calculated. In doing so, an X directional location of a base point 504 of the unique portion is determined. An Y directional length 502 of the protruding part means that the unique portion is present in a range from the base point 504 to a point that is the length 502 distant from the base point 504 in the Y direction, and also in a range from the base point 504 to a point that is the length 502 distant from the base point 504 in the X direction. That is, the unique portion is present within a square 505 formed by moving the base point 504 from the base point 504 by the length 502 in the X and Y directions. Note that methods for representing the distance from the identification mark to the unique portion and the range where the unique portion is present are not limited to the above methods. In the present embodiment, described is an example where, to prevent the identification mark from becoming too complicated, the range where the unique portion is present is represented by the location and length 502 of the protruding part; however, the present invention is not limited to this. A unique portion is not necessarily one having an aspect ratio of approximately 1. As with a unique portion 506 illustrated in FIG. 5, a horizontally long or vertically long unique portion may be present. In such a case, the present invention may be adapted to, by representing an X directional range by other means, more accurately represent the unique portion.

Figure 6:
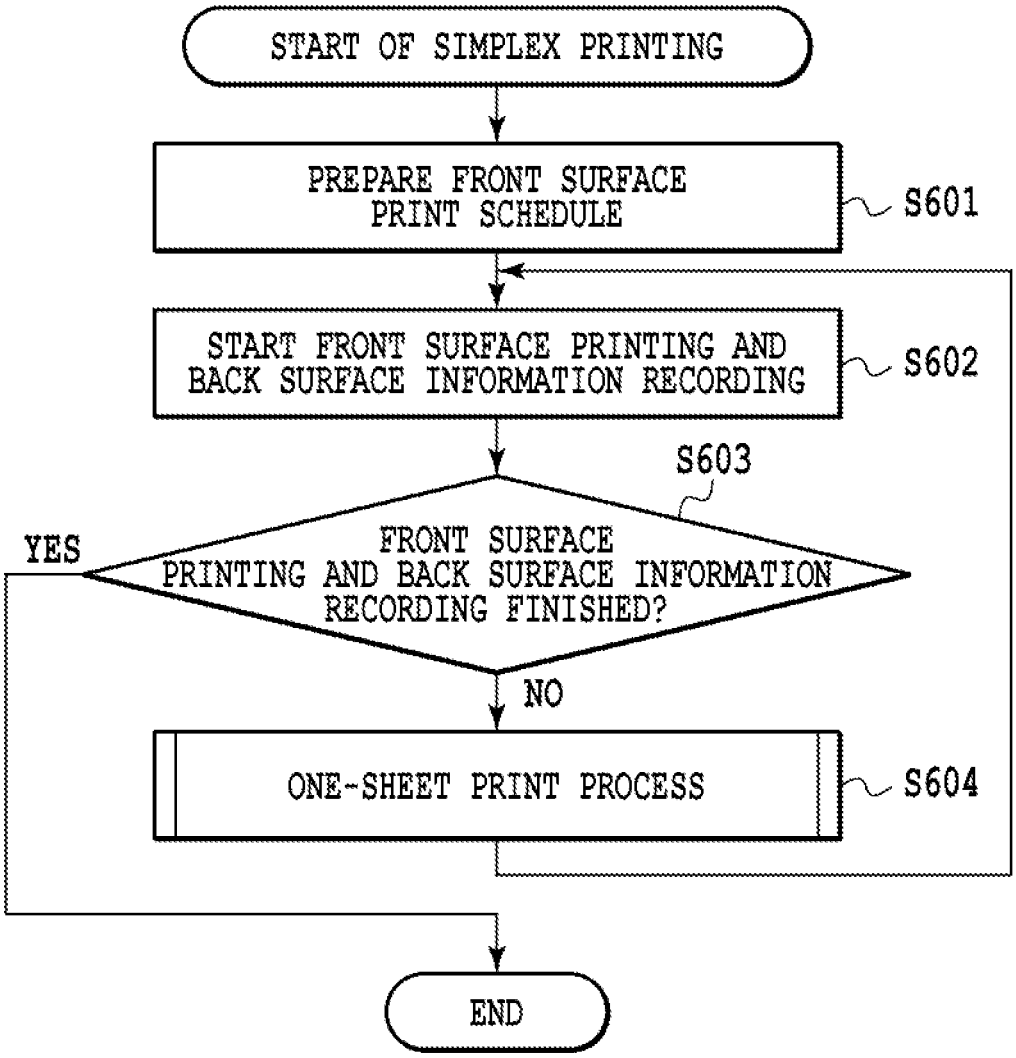
FIG. 6 is a flowchart illustrating a control flow at the time of printing back surface information on a back surface.

FIG. 6 is a flowchart illustrating an overall sequence of the print operation controlled by the control unit. In Step S601, on the basis of a print instruction, a front surface print schedule is prepared. The front surface print schedule refers to data that prescribes arrangement order of a plurality of unit images printed on a front surface of a continuous sheet, cut marks respectively formed in margin areas between adjacent images, preliminarily ejection areas, margin areas, and the like, and also on the basis of the arrangement order, prescribes order in which respective processing steps are performed.

In Step S602, according to the prepared front surface print schedule, the unit images and maintenance patterns are printed on the continuous sheet in the predetermined order prescribed in the front surface print schedule. In the case of the simplex printing, as needed, on a back surface of the sheet, information on the printed images is recorded (back surface information recording) by the information recording unit 7.

In the present embodiment, described is an example where in the case of the back surface information recording, printing is performed by a dot impact method; however, the present invention is not limited to this. For example, in the case of the back surface information recording, the printing may be performed by an inkjet method or a thermal transfer method. The present invention may be adapted such that content of the printing is specified by a user or automatically specified by the apparatus. Also, a specific content of the back surface information recording can be freely set depending on the intended use, such as a serial number to be used in post-processing such as bookbinding, or information on image correction, which is to be used at the time of printing the same image again.

In Step S603, it is determined whether the front surface printing prescribed in the front surface print schedule and back surface information printing have been completely finished (Yes) or not (No). If a result of the determination in Step S603 is Yes, the control flow sequence according to the present embodiment is ended. If the result of the determination is No, the flow proceeds to Step S604. Details of Step S604 will be described later with use of FIG. 7. Steps S603 and S604 are repetitively performed until the end of printing of all of the print images.

Figures 9A, 9B:
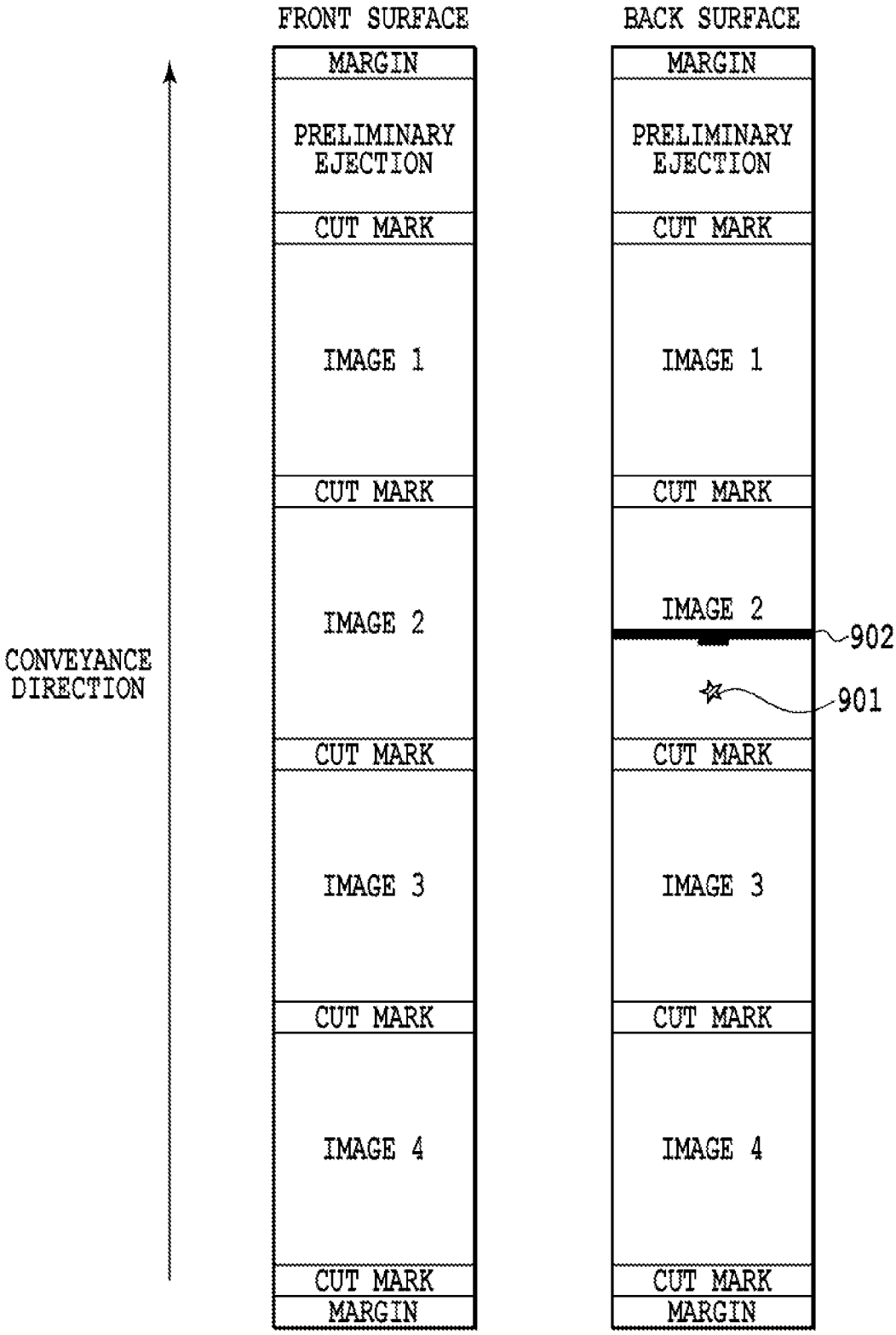
FIGS. 9A and 9B are explanatory diagrams for explaining schedules based on the types of print images printed on a front surface and on a back surface, respectively.

FIGS. 9A and 9B illustrates plan views in which print schedules regarding a sheet to be printed according to the flow in FIG. 6 are described, respectively. FIG. 9A illustrates the plan view regarding a front surface of the sheet, and FIG. 9B illustrates the plan view regarding a back surface of the sheet. On the front surface of the sheet, according to the front surface print schedule, unit images, a space for ink ejection at the time of preliminary ejection, and cut marks are respectively shown on the continuous sheet. In this example, arrangement order is shown such that first, the space for the preliminary ejection is arranged, and then the print images and the cut marks are sequentially alternately printed. The types of images to be printed include, in addition to the space for the preliminary ejection, unit images, and cut marks illustrated in FIGS. 9A and 9B as well as maintenance patterns (ejection failure monitoring pattern, recovery processing pattern), and the like. Here, description of the ejection failure monitoring pattern, preliminary ejection pattern, and recovery processing pattern is omitted.

FIG. 9B illustrates the plan view regarding the back surface corresponding to the images printed on the front surface of the sheet illustrated in FIG. 9A. In this example, on the back surface of the sheet to be printed with the image 2, a unique portion 901 is present, where an identification mark 902 is printed.

In Step S604 of the above-described control flow illustrated in FIG. 6, a control flow of the back surface information recording in the case where a unique portion is present in an area where printing is performed is described below.

Figure 7:
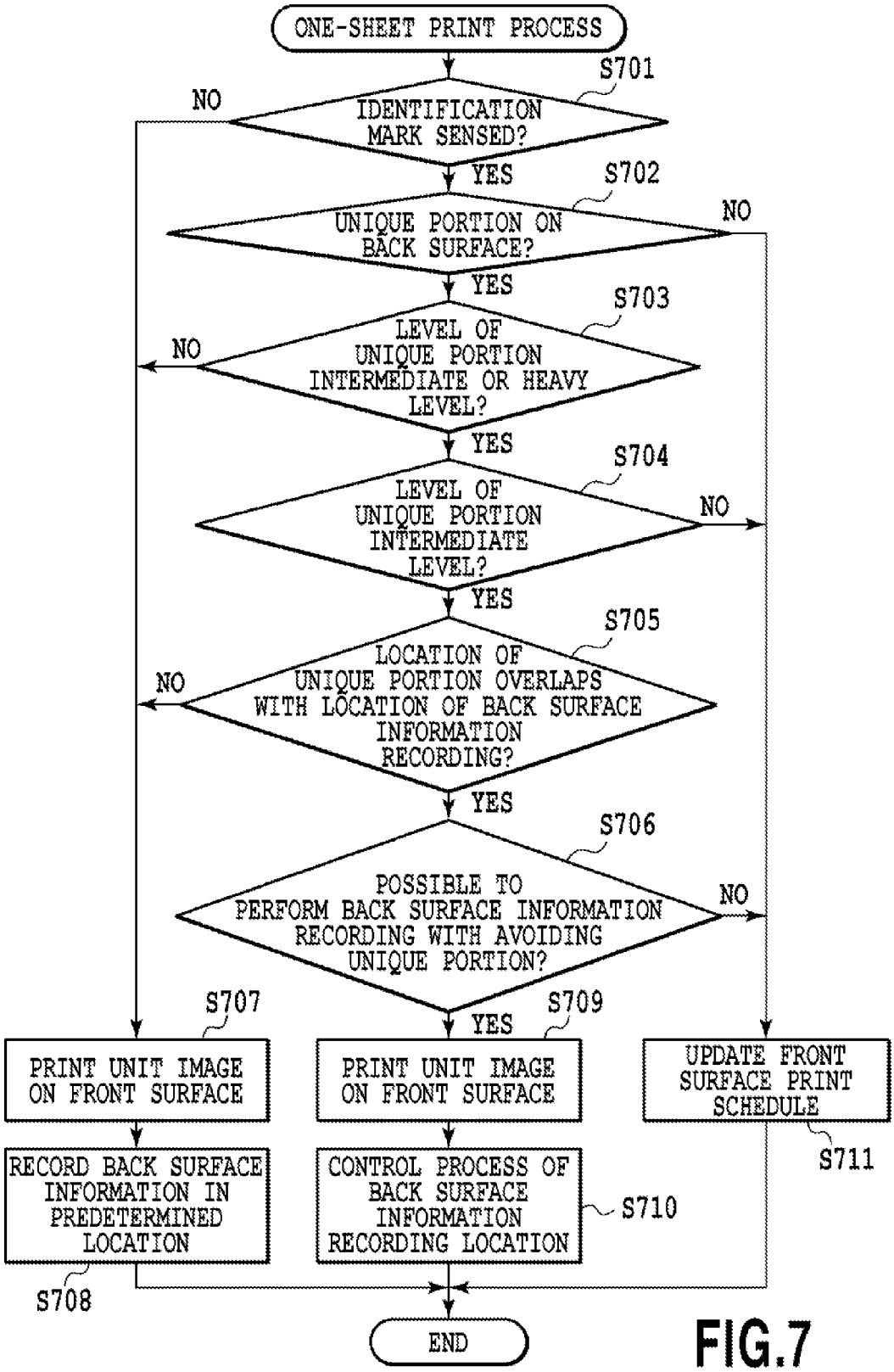
FIG. 7 is a flowchart illustrating a control flow in the case where a unique portion is present on a sheet.

FIG. 7 is a flowchart for explaining a detailed sequence of a one-sheet print process.

In Step S701, during printing, it is determined whether or not an identification mark printed on a continuous sheet has been sensed by the identification mark sensor 17. At this time, if a unique portion is present on the sheet and a result of the determination in Step S701 is Yes, the identification mark is read by the identification mark sensor 17 (reading process), and the flow proceeds to Step S702. If a unique portion is not present, and the result of the determination in Step S701 is No, the flow proceeds to Step S707, where an image is printed on a front surface, and also in Step S708, back surface information recording is performed in a predetermined location.

In Step S702, after it has been determined that a unique portion is present, it is determined whether the unique portion is present on the front or back surface. If the unique portion is present on the back surface (regions (b), (c), and (d) in FIG. 4), the flow proceeds to Step S703, whereas if the unique portion is present on the front surface (region (a) in FIG. 4), the flow proceeds to Step S711. In the case where it is determined that the unique portion is present on the front surface, printing cannot be performed in a part where the unique portion is present, and therefore in Step S711, a schedule is updated so as to, without performing printing in the part, convey the sheet to stop printing in the part.

In the case where in Step S702, it is determined that the unique portion is present on the back surface, in Step S703, it is determined whether uniqueness of the unique portion is at the light, intermediate, or heavy level. An example of uniqueness of the light, intermediate, or heavy level in the unique portion is as described above. If as a result of the determination in Step S703, a level of the uniqueness in the unique portion is the intermediate or heavy level (regions (b) and (c) in FIG. 4), Step S703 is determined as Yes, and the flow proceeds to Step S704. If the level of the uniqueness in the unique portion is the light level (region (d) in FIG. 4), it is determined in Step S703 to be No, and the flow proceeds to Step S707.

In the case where in Step S703, it is determined that the level of the uniqueness in the unique portion is the intermediate or heavy level, in Step S704, it is determined whether the uniqueness of the unique portion is at the intermediate level or the heavy level. If the level of the uniqueness in the unique portion is the intermediate level, it is determined in Step S704 to be Yes (region (c) in FIG. 4), and the flow proceeds to Step S705. In this case, the unique portion is at the intermediate level, and therefore the level of the uniqueness in the unique portion is determined to fall within a range where it is acceptable to perform the back surface information recording. On the other hand, if the level of the uniqueness in the unique portion is the heavy level at which direct printing is not acceptable, it is determined to be No (region (b) in FIG. 4), and the flow proceeds to Step S711.

In the case where in Step S704, it is determined that the level of the uniqueness of the unique portion is the intermediate level, in Step S705, it is determined whether or not a location of the unique portion overlaps with a predetermined location where the back surface information recording is performed. If the location of the unique portion overlaps with the predetermined location where the back surface information recording is performed, and a result of the determination in Step S705 is Yes (FIG. 10B), the flow proceeds to Step S706. If the location of the unique portion does not overlap with the predetermined location where the back surface information recording is performed, and the result of the determination in Step S705 is No, the flow proceeds to Step S707. Note that, in the present embodiment, in the case where the result of the determination in Step S705 is Yes, the flow proceeds to S706; however, the present invention may configure a flow to, at this point of time, determine that printing cannot be performed, and proceed to S711.

In the case where in Step S705, it is determined that the location of the unique portion overlaps with the predetermined location where the back surface information recording is performed, in Step S706, it is determined whether or not the printing apparatus can perform the back surface information recording with avoiding the location of the unique portion, and if a result of the determination in Step S706 is Yes (FIGS. 10C, 10D, and 10E), the flow proceeds to Step S709. On the other hand, if it is determined that the printing apparatus cannot perform the back surface information recording with avoiding the location of the unique portion, and it is determined in Step S706 to be No (FIG. 10F), the flow proceeds to Step S711.

In the case where the flow proceeds to Step S707, it is determined that a unique portion is not present, or even in the presence of a unique portion, the unique portion has a little influence on printing, and therefore normal printing on the front surface and the back surface information printing are possible. For this reason, in this case, in Step S707, unit images are printed on the front surface, and also in Step S708, the back surface information recording is performed in the predetermined location to end this sequence.

Also, the case where the flow proceeds to Step S709 is the case where although a unique portion is present on the back surface, printing on the front surface can be normally performed, and the back surface information recording can also be performed as long as the location of the recording is changed. Accordingly, in such a case, in Step S709, the printing on the front surface is normally performed, and also in Step S710, the back surface information recording is performed with the unique portion being avoided. Details of a processing step in Step S710 will be described later with use of FIG. 8.

Further, in the case where the flow proceeds to Step S711, the schedule for printing on the front surface is updated (resetting step). That is, to prevent printing from being performed in an area where the unique portion is present, the print schedule is updated so as to prevent printing on the front surface in the area and only convey the sheet. In other words, in the case where when pieces of information on a unique portion are read, it is determined that a level of the unique portion is larger than an acceptable level, or the unique portion is unavoidable, in a location where the unique portion is present, neither the front surface nor the back surface is printed. As described, to prevent printing on both of the front and back surface in the location where the unique portion is present, the schedule for printing on the sheet is reset, and the printing is controlled so as to perform the printing according to the reset schedule. It is assumed that regarding a level of the unique portion in this case, not only which of the level of the unique portion is, but also which of the front and back surfaces the unique portion is present on is determined. In the present embodiment, in the case where a unique portion is present on a front surface, the unique portion has an influence on printing an image on the frond surface, and therefore it is determined that a level of the unique portion is larger than a level at which direct printing is acceptable. Accordingly, in the case where a unique portion is present on a front surface of a sheet, it is determined that a level of the unique portion is larger than an acceptable level, and in a location on the sheet, where the unique portion is present, neither the front surface nor the back surface is printed. For this reason, a schedule for printing on the sheet is reset so as to prevent printing on both of the front and back surfaces in the location where the unique portion is present.

Figure 8:
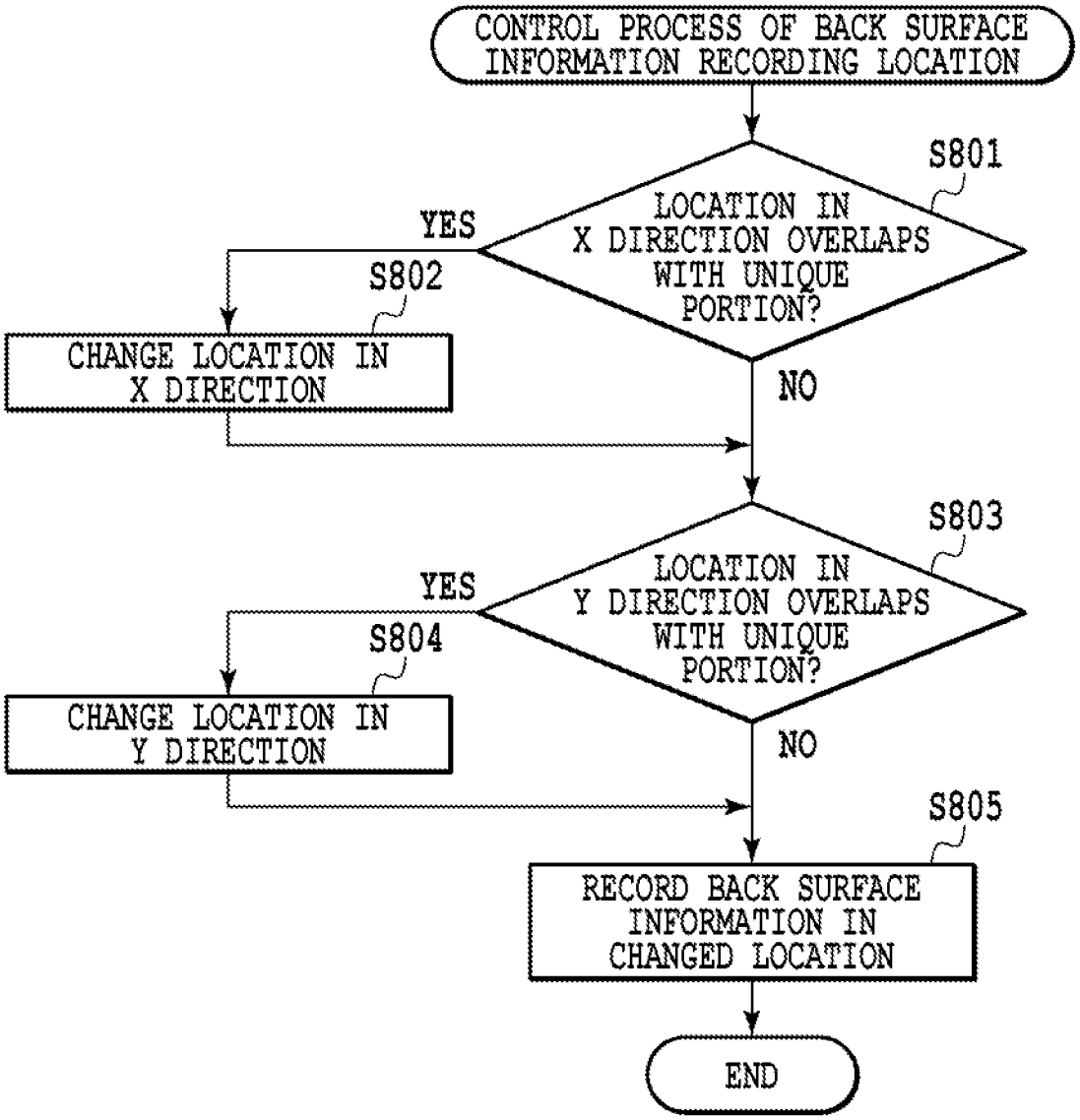
FIG. 8 is a flowchart illustrating a control flow in the case where a unique portion is present on a sheet, and by changing a back surface information recording location, printing on the unique portion is avoided.

Next, with use of FIG. 8, the case where in Step S710, the printing on the front surface is normally performed, and also the printing is performed with the location of the back surface information recording being changed is described with use of a flowchart. FIG. 8 is the flowchart illustrating a detailed sequence of a control process of the location of the back surface information recording. In Step S801, it is determined whether or not the predetermined location where the back surface information recording is performed overlaps with the location of the unique portion in the X direction. If the predetermined location where the back surface information recording is performed overlaps with the location of the unique portion in the X direction, and a result of the determination in Step S801 is Yes, the flow proceeds to Step S802. If the predetermined location where the back surface information recording is performed does not overlap with the location of the unique portion in the X direction, and the result of the determination in Step S801 is No, the flow proceeds to Step S803.

In Step S802, control is performed so as to, in the X direction, move the location of the back surface information recording by the information recording unit 7 to a location not to overlap with the unique portion and the identification mark.

In step S803, it is determined whether or not the predetermined location of the back surface information recording and the location of the unique portion overlap with each other in the Y direction. If the location of the back surface information recording and the location of the unique portion overlap with each other, and a result of the determination is Yes, the flow proceeds to Step S804, whereas if the location of the back surface information recording and the location of the unique portion do not overlap with each other, and the result of the determination is No, the flow proceeds to Step S805.

In Step S804, printing is controlled so as to, in the Y direction, move the location of the back surface information recording by the information recording unit 7 to a location not to overlap with the unique portion and the identification mark.

In Step S805, the back surface information recording is performed by the information recording unit 7 in the XY directional location changed in Steps S802 and S804 (control process) to end this sequence.

As described, in the case where it is determined that a level of a unique portion falls within an acceptable range, and by moving a location where a back surface printing is performed, the unique portion can be avoided to perform printing, the location of back surface information recording is changed. In this case, a schedule for printing a sheet is reset so as to change the print location on the back surface, and the printing is controlled so as to perform the printing according to the reset schedule (resetting process). It is here assumed that the change of the schedule includes not only a change of order of the types of images to be printed but also a change in location where printing is performed. Accordingly, making settings with changing a location of back surface information recording in order to perform printing with avoiding a unique portion is also included in the resetting of a schedule for printing on a sheet.

FIGS. 10A-10F are used to describe a process of moving a back surface information recording location or skipping printing image on a front surface. FIGS. 10A-10F illustrate images of back surface information at the time of performing back surface information recording and an identification mark. Content of the back surface information to be printed may be specified by a user or automatically specified by the apparatus. On sheets in FIGS. 10A-10F, pieces of back surface information 1002, 1005, 1008, 1011, and 1014, and identification marks 1004, 1007, 1010, 1013, and 1017 are printed. Also, on the sheets, unique portions 1003, 1006, 1009, 1012, 1015, and 1016 are formed.

Figure 10A:
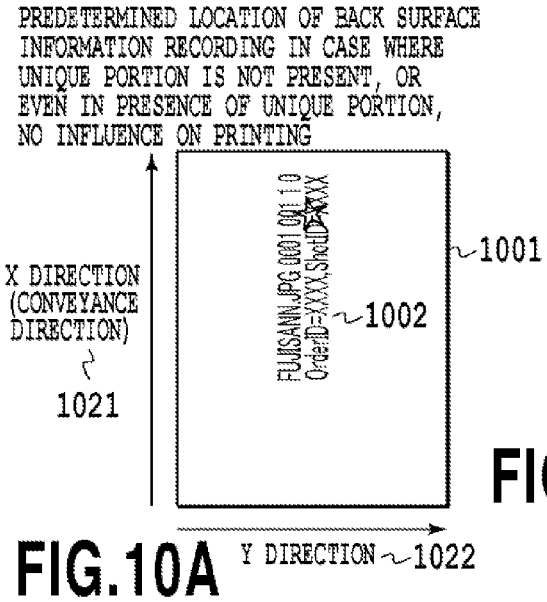
FIGS. 10A to 10F are explanatory diagrams for explaining a change of a print schedule, which in the case where a unique portion is present on a sheet, performed by changing a back surface information recording location depending on the type of the unique portion.

In FIG. 10A, a back surface information recording location in the case where on a back surface of the sheet, a unique portion is not present, or in the case where although a unique portion is present, a level of the unique portion is the light level and small, and therefore the unique portion does not influence printing is shown. In the case where on the sheet, a unique portion is not present, or although a unique portion is present on the sheet, the unique portion does not influence printing, an identification mark is not formed on the sheet, and the back surface information is printed in an originally scheduled predetermined location. In this case, in the flowchart of FIG. 7, the flow proceeds from Step S701 to Step S707. In this case, an image is printed on a front surface, and also in the predetermined location on a back surface, the back surface information recording is performed.

Each of FIGS. 10B to 10F illustrates the sheet in the case where on a back surface of the sheet, a unique portion having the intermediate level illustrated in region (c) in FIG. 4 is present. Also, depending on a size and/or location of the unique portion, an identification mark corresponding to the unique portion is printed on the sheet. As illustrated in each of the FIGS. 10B to 10F, in the case where on the back surface of the sheet, the intermediate level unique portion is present, in the flowchart illustrated in FIG. 7, the flow proceeds from S704 to Step S705.

Figure 10B:
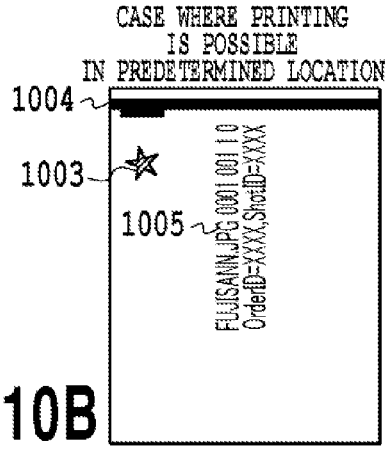

In this case, in the case where, as illustrated in FIG. 10B, a location where the unique portion is present does not overlap with the back surface information recording location, the flow illustrated in FIG. 7 proceeds from Step S705 to S707. In Step S707, an image is printed on a front surface, and also in Step S708, the back surface information is printed in the originally scheduled predetermined location (control process).

Figure 10C:
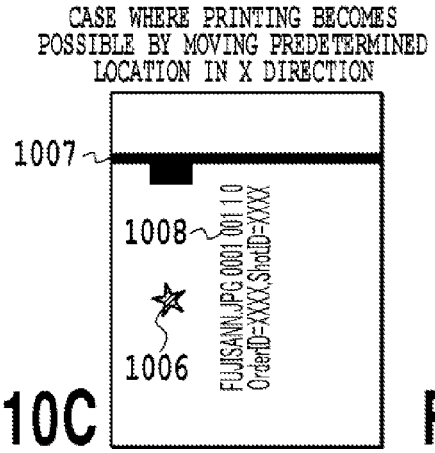
Figure 10D:
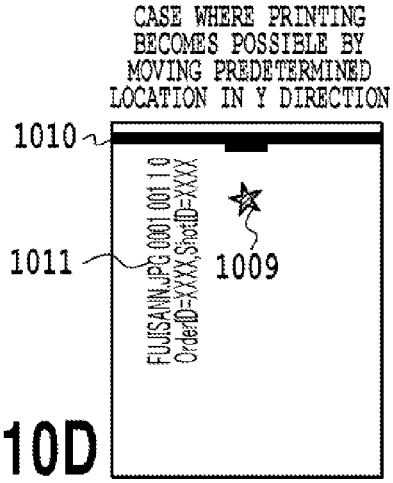
Figure 10E:
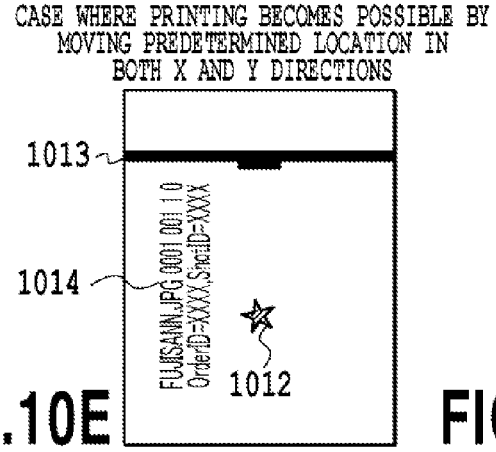

Also, as illustrated in FIGS. 10C to 10E, in the case where a location of the unique portion and the back surface information recording location overlap with each other, the flow illustrated in FIG. 7 proceeds from Step S705 to S706. In this case, the identification mark and the back surface information recording location overlap with each other, and therefore the case where it is necessary to change the back surface information recording location is assumed to be included. Also, in the case where by moving the back surface information recording location, the back surface information recording can be performed with the unique portion being avoided, the flow in the flowchart illustrated in FIG. 7 proceeds from Step S706 to S709. Then, in Step S709, an image is printed on a front surface, and also the back surface information recording is performed with the print location being changed.

As illustrated in FIG. 10C, in the case where it is necessary to move the back surface information recording location in the X direction (sheet conveyance direction), in the flowchart of FIG. 8 illustrating the processing step in Step S710, the flow proceeds from Step S801 to Step S802. In this case, by moving the back surface information recording location in the X direction, printing can be performed so as to prevent the identification mark and the back surface information recording location from overlapping with each other. Note that, in the present embodiment, the back surface information recording location is moved downward; however, the back surface information recording location may be moved upward. Priority of a direction in which the print location is moved may be set by a user or automatically set by the apparatus.

Also, as illustrated in FIG. 10D, in the case where it is necessary to move the back surface information recording location in the Y direction (sheet width direction), in the flowchart of FIG. 8 illustrating the processing step of Step S710, the flow proceeds from Step S803 to Step S804. In this case, by moving the back surface information recording location in the Y direction, printing can be performed so as to prevent a location of the unique portion and the back surface information recording location from overlapping with each other. Note that, in the present embodiment, the back surface information recording location is moved leftward; however, the back surface information recording location may be moved rightward. Also, priority of a direction in which the print location is moved may be able to be set by a user, or may be automatically set by the apparatus.

Further, as illustrated in FIG. 10E, in the case where it is necessary to move the back surface information recording location in both of the X and Y directions, in the flowchart of FIG. 8, the flow proceeds from Step S801 to Step S802 as well as proceeding from Step S803 to Step S804. In this case, by moving the back surface information recording location in both of the X and Y directions, printing can be performed so as to prevent a location of the unique portion and the back surface information recording location from overlapping with each other (control process).

Figure 10F:
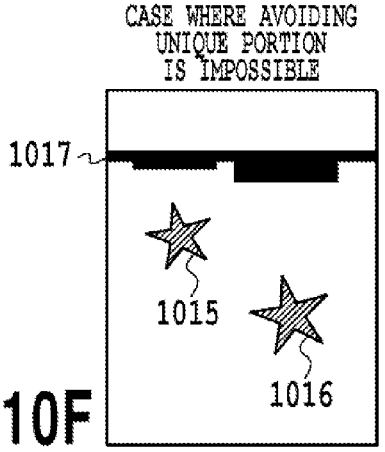

Still further, as illustrated in FIG. 10F, in the case where even if the back surface information recording location is moved in any manner, it is impossible to avoid locations of the unique portions and the back surface information recording location from overlapping with each other, a front surface print schedule is updated so as to skip the unique portions. FIG. 10F illustrates the case where the locations of the unique portions overlap with the back surface information recording location, and the unique portions are relatively large, so that even if the back surface information recording location is moved so as to avoid the unique portions, a space for printing is not enough, and therefore the printing cannot be performed. In this case, in the flowchart illustrated in FIG. 7, the flow proceeds from Step S706 to S711, and it is determined that front surface printing cannot be performed. As described, in the case where even if a print location on a back surface is moved, printing cannot be performed with a unique portion being avoided, a print schedule is reset so as to prevent printing from being performed on both front and back surfaces in a location where the unique portion is present (resetting process). Then, printing is controlled so as to perform the printing according to the reset schedule (control process).

FIGS. 11A-11D are used to specifically describe the case of, in S711 in the flowchart of FIG. 7, updating a front surface print schedule.

Figure 11A:
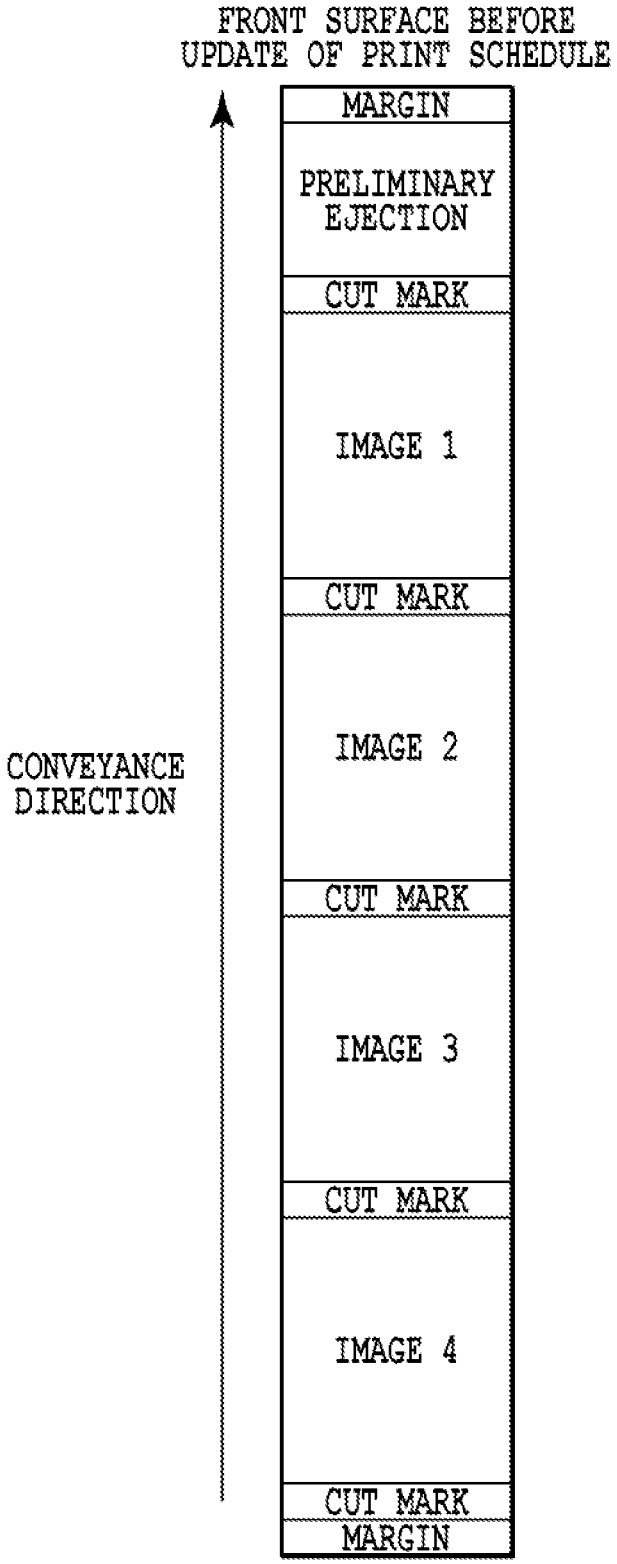
FIGS. 11A to 11D are explanatory diagrams for explaining a change of a print schedule, which in the case where a unique portion is present on a sheet, performed by setting unprintable areas for front surface printing and back surface printing, respectively.
Figure 11B:
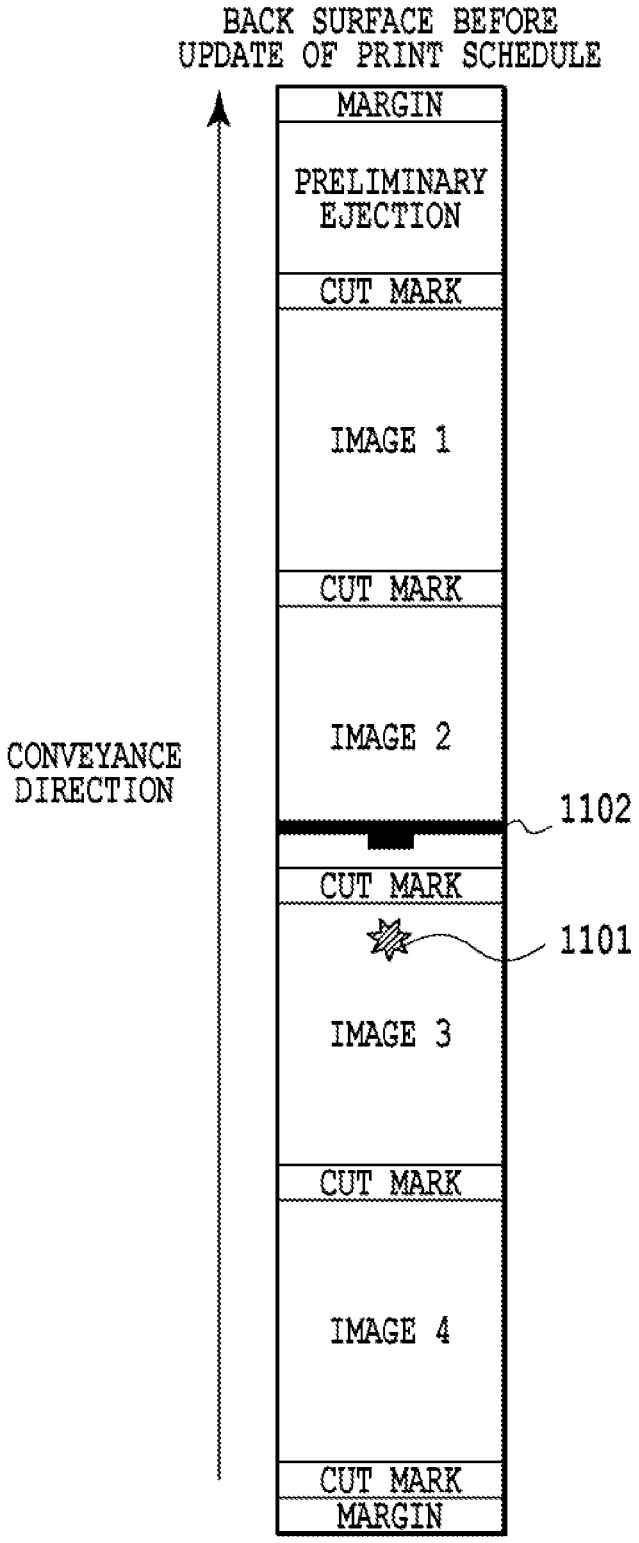

FIGS. 11A and 11B illustrate plan views in which print schedules regarding a sheet to be printed are described. FIG. 11A illustrates the plan view regarding a front surface of the sheet before the print schedule is updated, and FIG. 11B illustrates the plan view regarding a back surface of the sheet before the print schedule is updated. On the front surface of the sheet, according to the front surface print schedule, spaces for printing unit images, and spaces for printing cut marks are alternately shown in the sheet. Also, at the head of the sheet, a margin and a space for ejecting ink for preliminary ejection are provided.

FIG. 11B illustrates the back surface print schedule corresponding to the front surface print schedule in FIG. 11A. In the present embodiment, a unique portion 1101 is at the heavy level, and in a part where the unique portion 1101 is present, neither the front surface nor the back surface can be printed. Also, the unique portion 1101 is at the heavy level, and therefore an identification mark 1102, which is formed on the back surface of the sheet correspondingly, indicates the presence of the heavy level unique portion.

Figure 11C:
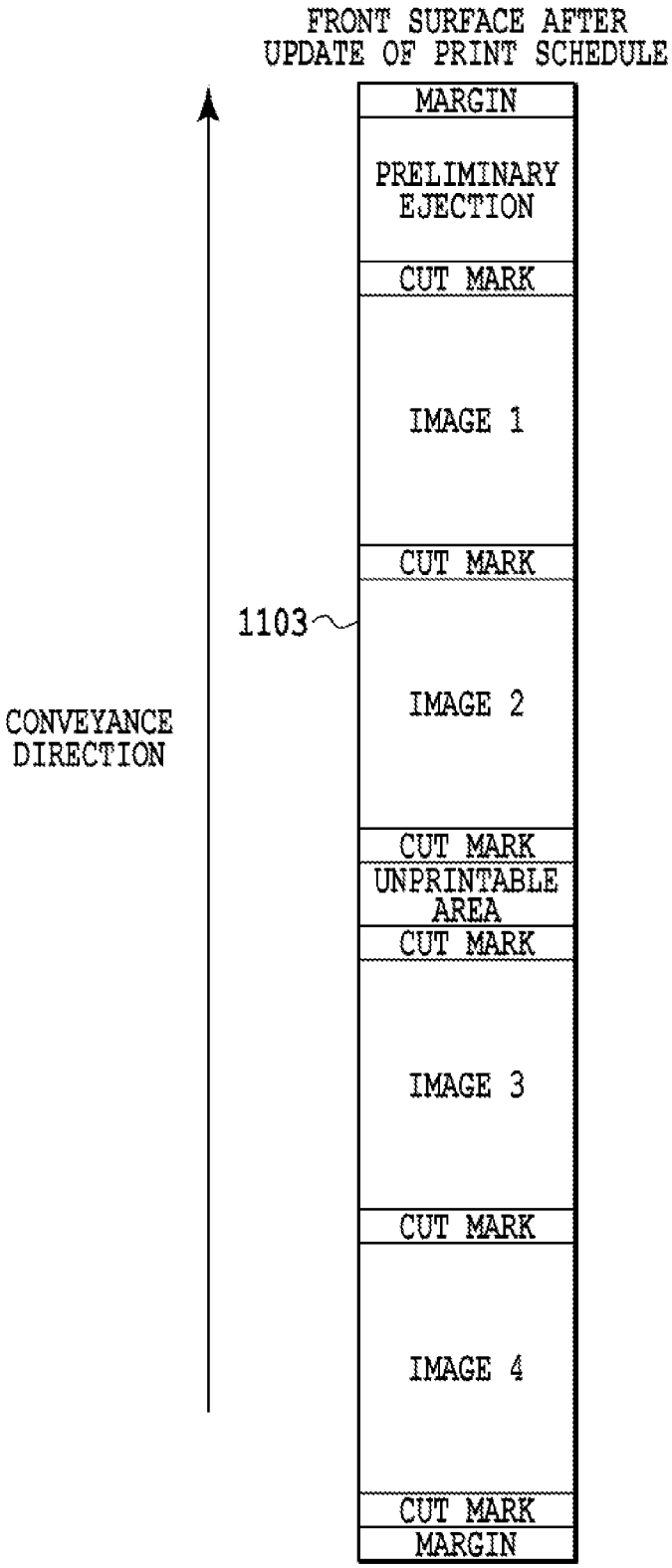
Figure 11D:
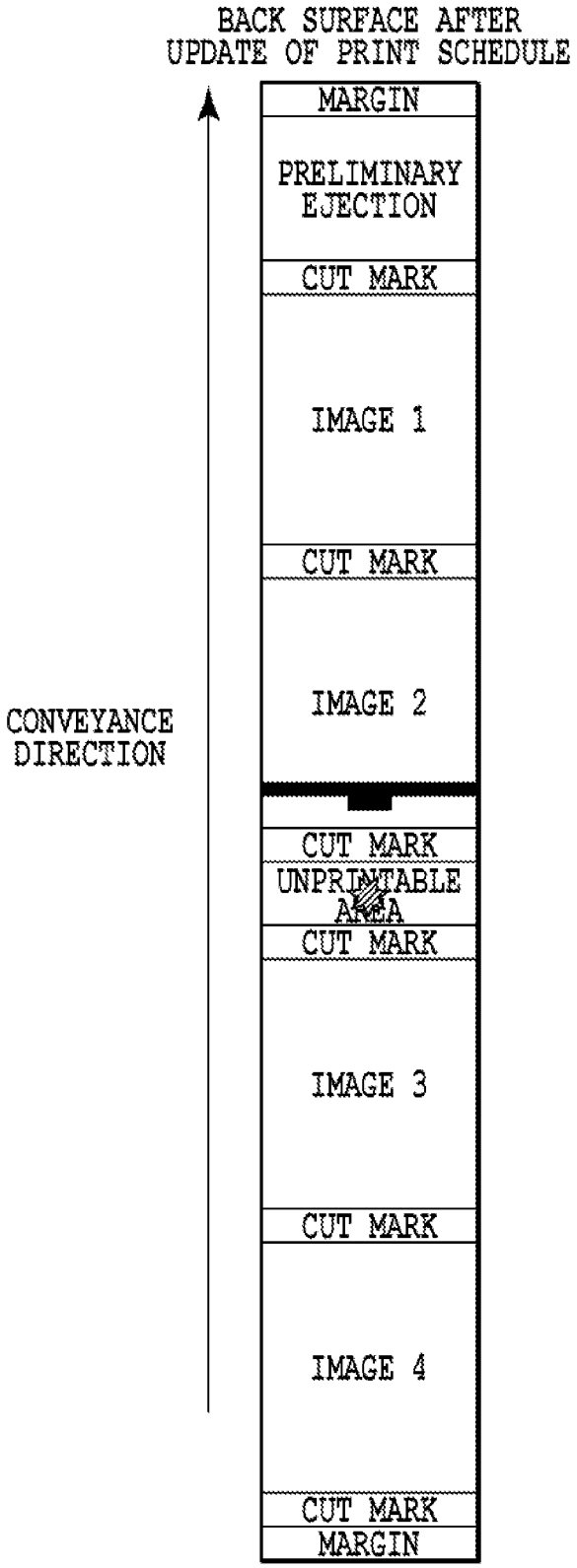

In such a case, in the part where the unique portion 1101 is present on the back surface, the image cannot be printed, and therefore it is necessary to update the print schedules to skip the unique portion without using the unique portion for the printing. FIG. 11C is a plan view illustrating a front surface print schedule that has been updated in order to avoid printing on the unique portion 1101 in FIG. 11B. Also, FIG. 11D is a plan view illustrating a back surface print schedule that has been updated in order to avoid printing on the unique portion 1101 in FIG. 11B. Arrangement order in which a space for preliminary ejection, unit images, cut marks are sequentially printed on the sheet is illustrated. In a scheduled location to print an image 3 in FIG. 11B, the heavy level unique portion 1101 is present, and therefore by changing the schedule, on a forward side of the image 3, an unprintable area 1103 is inserted.

As described above, on the basis of pieces of information read from the identification mark by the identification mark sensor 17, the schedule for performing the printing on the sheet is reset from the preset print schedule. Then, according to the reset schedule, the printing is controlled so as to perform the printing by the printing unit 4 (control process). In the present embodiment, the control unit 13 functions as control means adapted to control printing.

As described, the schedule for printing on the front surface is reset, and thereby between printing of an image 2 and printing of the image 3 on the front surface, the unprintable area can be arranged. This enables the unique portion 1101 to be avoided from being present in an area corresponding to an image on the front surface. The heavy level unique portion 1101 is arranged in a location corresponding to the unprintable area, and therefore the heavy level unique portion 1101 can be suppressed from influencing the image printing on the front surface and the back surface information recording on the back surface.

As described above, in the case where at the time of back surface information recording, a unique portion cannot be avoided only by moving a back surface information recording location, a front surface print schedule is updated. After the front surface print schedule has been updated and reset, this sequence is ended.

As in the above-described embodiment, in the case where many unit images are printed by simplex printing at one time, during a processing at one time, an identification mark part may be sensed a plurality of times. As described, when in the simplex print mode, an identification mark printed on a sheet is sensed, on the basis of the sensing, it is determined whether or not back surface information recording can be performed. As a result of the determination, in the case where the back surface information recording can be performed only by moving a back surface information recording location, the back surface information recording location is controlled. On the other hand, in the case where the back surface information recording cannot be performed only by moving the back surface information recording location, for printing an image on a front surface, an unprintable area is set to skip the printing on the front surface. Then, a print schedule is set so as to locate a unique portion in an area corresponding to the unprintable area on the front surface.

According to the present embodiment, depending on a sheet surface where a unique portion is present, a location of the unique portion, and/or a level (type) of the unique portion, a print schedule is appropriately set. For this reason, even in the presence of a unique portion on a sheet, a part corresponding to the unique portion is not unconditionally discarded, but effectively used depending on the unique portion. Accordingly, a print sheet can be more efficiently used, and therefore an amount of use of print sheets can be reduced to keep operating cost of a printing apparatus low.

Also, in the case where a unique portion cannot be avoided only by moving a back surface information recording location, a schedule is updated to set an unprintable area, and thereby front surface printing can be skipped so as to locate the unique portion in an area corresponding to the unprintable area. Accordingly, back surface information recording can be surely performed, and an image obtained by printing can be suppressed from being damaged by the presence of the unique portion.

Note that, in the present embodiment, described is the case of performing the print process on one sheet; however, for example, in the case of printing a plurality of sheets, such as photobook printing, a larger effect can be obtained. In the case of performing a print process regarding the photobook printing, a plurality of sheets is printed, and then a bookbinding process is performed. In this case, if at least one printing failure sheet is found after the bookbinding, such as the case where front surface printing or back surface information recording is performed on a unique portion having a level enough to influence a printed image, the whole of one photobook may be made useless. In such a case, it may be necessary to reprint all of the sheets printed with respect to the photobook printing. According to the present embodiment, front surface printing and back surface information recording are performed with a unique portion being surely avoided, and therefore reprinting after bookbinding can be avoided to further reduce an amount of useless use of print sheets. Accordingly, an amount of print sheet consumption can be further reduced.

Figure 12:
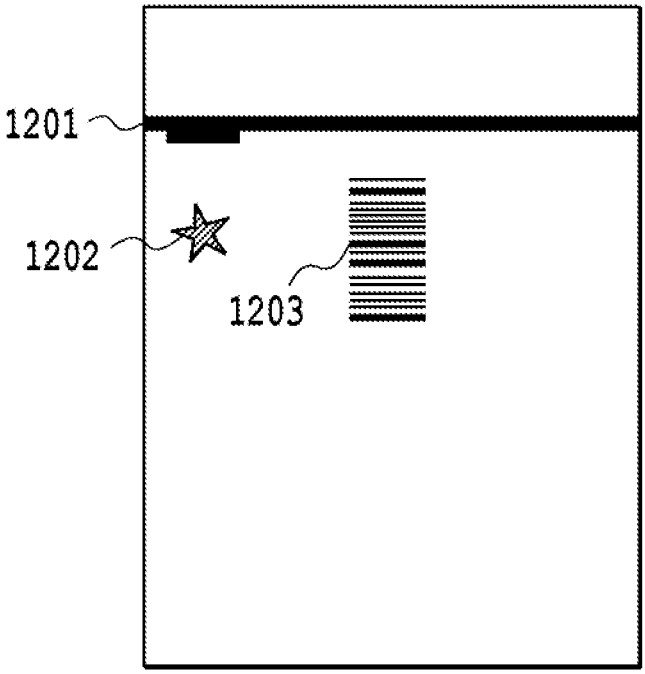
FIG. 12 is a plan view illustrating a back surface of a sheet in the case where back surface information on the back surface is printed as a barcode.

Further, in the present embodiment, as additional information, described is the case of performing back surface information recording that prints back surface information including characters and the like on a back surface of a sheet; however, the present invention is not limited to this. For example, as illustrated in FIG. 12, the case of printing a barcode 1203 on a back surface can also be applied with the present invention. In FIG. 12, a unique portion 1202 is present, and an identification mark 1201 corresponding to the unique portion 1202 is printed on a sheet. In the present embodiment, pieces of information the barcode 1203 is made to have include, for example, a binding method at the time of bookbinding, information on sheets to be mutually stuck, cover information, and the like. By using the barcode, processing can be, without a hand, automatically transferred to a process after printing. Even in such a configuration, as described, if printing failure is found in post processing such as bookbinding, an amount of sheets of paper corresponding to the processing is made useless, and also reprinting is required, so that many print sheets are consumed to increase cost. For this reason, even in automated lab print processing, preventing printing failure at the time of printing is further important. By applying the present invention, the printing failure at the time of printing can be kept low in terms of occurrence frequency.

Still further, in the present embodiment, described is the case where a roll shape continuous sheet is cut after printing and then outputted; however, the present invention is not limited to this. The roll shape continuous sheet can also be outputted in a roll state after printing and directly transferred to a subsequent process. In the case where the roll shape continuous sheet is outputted from the printing apparatus in the roll state, it is difficult to find printing failure after printing, and therefore preventing the printing failure at the time of printing is further important. By applying the present invention, the printing failure at the time of printing can be kept low in terms of occurrence frequency.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-169675, filed Jul. 31, 2012, which is hereby incorporated by reference herein in its entirety.

What is claimed is:

1. A print control method for printing a plurality of images on a continuous sheet, the method comprising:

obtaining information about the continuous sheet to be used, the information representing a location of a unique portion unsuitable for image printing that exists on the continuous sheet and a degree of influence of the unique portion in printing, the degree of influence of the unique portion which the obtained information represents being one of a plurality of degrees;

determining, if the unique portion exists on an opposite sheet surface to a first sheet surface in which the plurality of images is printed, whether the degree of influence of the unique portion which the obtained information represents is a degree to which performing of printing is affected in the first sheet surface of the continuous sheet;

causing a print unit not to perform printing in an area of the first sheet surface corresponding to the unique portion in the opposite sheet surface in a case where it is determined that the degree of influence of the unique portion which the obtained information represents is the degree to which performing printing is affected in the first sheet surface of the continuous sheet; and causing the print unit to perform printing in the area of the first sheet surface corresponding to the unique portion in the opposite sheet surface in a case where it is determined that the degree of influence of the unique portion which the obtained information represents is a degree to which performing of printing is not affected in the first sheet surface of the continuous sheet.

2. The method according to claim 1, wherein in duplex printing for printing images on the first sheet surface of the continuous sheet, and on a second surface that is the opposite sheet surface, setting a schedule for the duplex printing, on a basis of the information representing which of the first sheet surface and the second sheet surface the unique portion exists.

3. The method according to claim 2, wherein, in a case where the unique portion has the degree to which performing printing is affected in each of the both surfaces of the sheet, in the location where the unique portion is present, any image is prevented from being printed on the both surfaces.

4. The method according to claim 2, wherein in a case where the unique portion is present on the second surface, information with respect to corresponding images printed on the first surface is recorded on the second surface.

5. The method according to claim 1, wherein the information is preliminarily recorded on one of sheet surfaces, and obtained by being read by a sensor.

6. The method according to claim 1, wherein the information is collectively recorded in a leading end part of the continuous sheet, and obtained by being read by a sensor.

7. The method according to claim 1, wherein the information is collectively recorded on a package for the continuous sheet, or collectively recorded in a memory medium attached to the package, and obtained by being read by a reading device.

8. The method according to claim 1, wherein the plurality of images is printed on the first sheet surface of the continuous sheet, and further comprising performing printing image information in a second sheet surface that is the opposite sheet surface.

9. The method according to claim 8, wherein, in the performing step of printing on the opposite sheet surface, the image information is printed on the opposite sheet surface so that the printed image information does not overlap the location of the unique portion in a case where it is determined that the degree of the unique portion which the obtained information represents is a degree to which performing of printing is not affected when printing on the first sheet surface of the continuous sheet, and is a degree to which the image information cannot be recognized if the image information is printed on the unique portion on the opposite sheet surface.

10. The method according to claim 8, wherein, in the performing step for printing on the opposite sheet surface, the image information is printed so that the image information does not overlap the location of the unique portion in a case where it is determined that the degree of the unique portion which the obtained information represents is the degree to which performing of printing is not affected when printing on the first sheet surface of the continuous sheet, and is a degree to which the image information cannot be recognized if the image information is printed on the unique portion, and printing of the image information can avoid the unique portion on the opposite sheet surface.

11. The method according to claim 10, wherein the printing location of the image is changed at least one of the location in a conveying direction of the continuous sheet and a location in a direction intersecting the conveying direction, from a predetermined printing location.

12. The method according to claim 8, wherein, in the performing step for printing on the opposite sheet surface, the image information is printed without changing a printing location in a case where it is determined that the degree of the unique portion which is obtained information represents is the degree to which performing of printing is not affected in the first sheet surface of the continuous sheet, and a degree to which the image information can be recognized if the image information is printed on the unique portion.

13. The method according to claim 8, wherein, the image information is information on an image to be printed on a first surface of the continuous sheet.

14. The method according to claim 1, wherein, in the causing step for causing printing in the area of the first sheet surface, the print unit is caused not to perform printing to an area on the first sheet surface corresponding to the unique portion in a case where it is determined that the degree of the unique portion which the obtained information represents is the degree to which performing of printing on the first sheet surface is not affected, and is a degree to which the image information cannot be recognized if the information is printed on the unique portion on the opposite surface, and printing of the image information cannot avoid the unique portion.

15. The method according to claim 1, wherein, in the causing step in which the print unit is caused to perform printing, the print unit is caused to print the image with changing a print schedule for an opposite sheet surface to a sheet surface in which the unique portion exists in a case where it is determined that the degree of the unique portion which the obtained information represents is the degree to which performing of printing is affected in the first sheet surface of the continuous sheet, and the print unit is caused to print the image without changing a print schedule for a sheet surface in which the unique portion exists in a case where it is determined that the degree of the unique portion which the obtained information represents is the degree to which performing of printing is not affected in the first sheet surface of the continuous sheet.

16. The method according to claim 1, wherein the information about the continuous sheet to be used is printed and indicates a sheet surface in which the unique portion exists.

17. A printing apparatus for printing a plurality of images on a continuous sheet, comprising:

an obtaining unit configured to obtain information about the continuous sheet to be used, the information representing a location of a unique portion unsuitable for image printing that exists on the continuous sheet and a degree of influence of the unique portion in printing, the degree of influence of the unique portion being one of a plurality of degrees;

a determining unit configured to determine, if the unique portion exists on an opposite sheet surface to a first sheet surface in which the plurality of images is printed, whether the degree of influence of the unique portion which the obtained information represents is a degree to which performing of printing is affected in the first sheet surface of the continuous sheet; and a print control unit configured to cause a print unit not to perform printing in an area of the first sheet surface corresponding to the unique portion in the opposite sheet surface in a case where it is determined that the degree of influence of the unique portion which is obtained information represents is the degree to which performing of printing is affected in the first sheet surface of the continuous sheet; and cause the print unit to perform printing on the area of the first sheet surface corresponding to the unique portion in the opposite sheet surface in a case where it is determined that the degree of influence of the unique portion which the obtained information represents is a degree to which performing of printing is not affected in the first sheet surface of the continuous sheet.

18. The printing apparatus according to claim 17, wherein in duplex printing for printing images on the first sheet surface of the continuous sheet and on a second sheet surface that is the opposite sheet surface, the printing control unit controls the duplex printing, on a basis of the information representing which of the first sheet surface and the second sheet surface the unique portion exists.

19. The printing apparatus according to claim 18, wherein, in a case where the unique portion has the degree which affects the both surfaces of the sheet, in the location where the unique portion is present, any image is prevented from being printed on the both surfaces.

20. The printing apparatus according to claim 18, wherein in a case where the unique portion is present on the second surface, information with respect to corresponding images printed on the first surface is recorded on the second surface.

21. The printing apparatus according to claim 17, wherein the information is preliminarily recorded on one of sheet surfaces, and obtained by being read by a sensor.

22. The printing apparatus according to claim 17, wherein the information is collectively recorded in a leading end part of the continuous sheet, and obtained by being read by a sensor.

23. The printing apparatus according to claim 17, further comprising the printing unit.

* * * * *